US010611168B2

(12) United States Patent
Nakajima

(10) Patent No.: US 10,611,168 B2
(45) Date of Patent: Apr. 7, 2020

(54) LIQUID EJECTING APPARATUS AND CONTROL METHOD OF LIQUID EJECTING APPARATUS

(71) Applicant: SEIKO EPSON CORPORATION, Tokyo (JP)

(72) Inventor: Yoshinori Nakajima, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/129,568

(22) Filed: Sep. 12, 2018

(65) Prior Publication Data

US 2019/0077162 A1 Mar. 14, 2019

(30) Foreign Application Priority Data

Sep. 13, 2017 (JP) ..... 2017-175721

(51) Int. Cl.

| | |
|---|---|
| ***B41J 2/175*** | (2006.01) |
| ***B41J 2/17*** | (2006.01) |
| ***B41J 2/18*** | (2006.01) |
| ***B41J 2/19*** | (2006.01) |
| ***B41J 2/165*** | (2006.01) |
| ***B41J 2/14*** | (2006.01) |

(52) U.S. Cl.

CPC ..... *B41J 2/17596* (2013.01); *B41J 2/14233* (2013.01); *B41J 2/16505* (2013.01); *B41J 2/16508* (2013.01); *B41J 2/16517* (2013.01); *B41J 2/16526* (2013.01); *B41J 2/175* (2013.01); *B41J 2/1721* (2013.01); *B41J 2/18* (2013.01); *B41J 2/19* (2013.01); *B41J 2002/1735* (2013.01); *B41J 2202/11* (2013.01); *B41J 2202/12* (2013.01)

(58) Field of Classification Search

CPC ..... B41J 2/18

See application file for complete search history.

(56) References Cited

U.S. PATENT DOCUMENTS

| | | | | |
|---|---|---|---|---|
| 2011/0199424 | A1* | 8/2011 | Yokouchi | B41J 2/16508 347/29 |
| 2011/0242235 | A1 | 10/2011 | Kitamura | |
| 2012/0007902 | A1* | 1/2012 | Hiratsuka | B41J 2/175 347/7 |

(Continued)

FOREIGN PATENT DOCUMENTS

| | | | |
|---|---|---|---|
| JP | 2006-88564 | A | 4/2006 |
| JP | 2011-212898 | A | 10/2011 |
| JP | 2014-58166 | A | 4/2014 |

*Primary Examiner* — Shelby L Fidler

(74) *Attorney, Agent, or Firm* — Workman Nydegger

(57) ABSTRACT

A control method of a liquid ejecting apparatus is provided. The liquid ejecting apparatus includes a liquid ejecting head that has an inner space in which a liquid flows and that ejects the liquid in the inner space through a nozzle, an inflow channel through which the liquid flows into the inner space, an outflow channel through which the liquid in the inner space flows out, and a valve element that opens and closes the inflow channel. The control method includes opening the inflow channel by opening the valve element in accordance with a negative pressure on a downstream side of the valve element to generate a liquid flow from the inflow channel to the outflow channel through the inner space. A pressure on an upstream side of the valve element is increased more in a case where a flow amount of the liquid flow is larger.

20 Claims, 15 Drawing Sheets

(56) References Cited

U.S. PATENT DOCUMENTS

| | | | | |
|---|---|---|---|---|
| 2012/0162331 | A1* | 6/2012 | Kataoka | B41J 2/175<br>347/89 |
| 2013/0169710 | A1* | 7/2013 | Keefe | B41J 2/175<br>347/17 |
| 2017/0087864 | A1* | 3/2017 | Akishiba | B41J 2/14233 |
| 2018/0072069 | A1* | 3/2018 | Hara | B41J 2/04541 |

* cited by examiner

LIQUID EJECTING APPARATUS AND CONTROL METHOD OF LIQUID EJECTING APPARATUS

BACKGROUND

1. Technical Field

The present invention relates to technology of ejecting a liquid such as ink.

2. Related Art

Some liquid ejecting apparatuses that eject liquids such as inks through liquid ejecting heads suppress precipitation of components of the liquid by generating a flow of liquid in the liquid ejecting heads. For example, JP-A-2011-212898 discloses a technique of providing a circulating path in a flow channel of a liquid ejecting head and generating a liquid flow in the flow channel of the liquid ejecting head by circulating the liquid through the circulating path. In JP-A-2011-212898, a valve element is provided in the circulating path, and the pressure of the liquid flowing in the circulating path is adjusted by opening the valve element on the basis of a negative pressure on the downstream side of the valve element and the atmospheric pressure.

SUMMARY

In a configuration in which the valve element is opened on the basis of a negative pressure on the downstream side of the valve element and the atmospheric pressure as in JP-A-2011-212898, the flow amount of the liquid flow generated in the liquid ejecting head can be increased more in the case where the negative pressure on the downstream side of the valve element is increased more. However, in the case where the negative pressure on the downstream side of the valve element is increased more, there is a higher possibility that the meniscus in the nozzle is broken because the negative pressure in the nozzle increases more. Considering the circumstances described above, an advantage of some aspects of the invention is to suppress the breakage of the meniscus in the nozzle even in the case where the flow amount of the liquid flow generated in the liquid ejecting head is increased.

Aspect 1

A method according to a preferable aspect (Aspect 1) of the invention is a control method of a liquid ejecting apparatus. The liquid ejecting apparatus includes a liquid ejecting head that has an inner space in which a liquid flows and that ejects the liquid in the inner space through a nozzle, an inflow channel through which the liquid flows into the inner space, an outflow channel through which the liquid in the inner space flows out, and a valve element that opens and closes the inflow channel. The control method includes opening the inflow channel by opening the valve element in accordance with a negative pressure on a downstream side of the valve element to generate a liquid flow from the inflow channel to the outflow channel through the inner space. A pressure on an upstream side of the valve element is increased more in a case where a flow amount of the liquid flow is larger. According to the aspect described above, a liquid flow can be generated in the liquid ejecting head by opening inflow channel by opening the valve element in accordance with a negative pressure on the downstream side of the valve element. At this time, although the negative pressure in the nozzle increases more in the case where the flow amount of the liquid flow is larger, the increase in the negative pressure in the nozzle can be reduced because the pressure on the upstream side of the valve element is increased more in the case where the flow amount of the liquid flow is larger. According to this, the breakage of the meniscus caused by the increase in the negative pressure in the nozzle can be suppressed even in the case where the flow amount of the liquid flow generated in the liquid ejecting head is increased.

Aspect 2

In a preferable example (Aspect 2) of Aspect 1, the valve element is opened by depressurizing the outflow channel. According to the aspect described above, the vale element is opened by depressurizing the outflow channel, thus the valve element is more likely to be opened and the flow amount of the liquid flow is more likely to increase.

Aspect 3

In a preferable example (Aspect 3) of Aspect 1 or 2, the liquid ejecting apparatus includes a flexible film for moving the valve element, the flexible film has a first surface that constitutes part of the inflow channel downstream of the valve element and a second surface opposite to the first surface, and the valve element is opened by deformation of the flexible film according to pressure difference between a pressure on the first surface and a pressure on the second surface. According to the aspect described above, the liquid flow by the first control can be performed by opening the valve element by deformation of the flexible film according to the pressure difference between the first surface and the second surface.

Aspect 4

In a preferable example (Aspect 4) of Aspect 3, the valve element is opened regardless of the pressure difference by deforming the flexible film by applying an external force to the second surface of the flexible film. According to the aspect described above, the valve element can be opened by deforming the flexible film regardless of the pressure difference by applying an external force to the second surface of the flexible film.

Aspect 5

In a preferable example (Aspect 5) of any one of Aspects 1 to 4, the liquid ejecting apparatus includes a cap that comes into contact with the liquid ejecting head to seal the nozzle, and the liquid flow from the inflow channel to the outflow channel through the inner space is generated by opening the inflow channel by opening the valve element in accordance with a negative pressure on a downstream side of the valve element in a state in which the liquid ejecting head and the cap are separated from each other. According to the aspect described above, since the liquid flow is generated in a state in which the liquid ejecting head and the cap are separated from each other, the meniscus of the nozzle can be less likely to be broken by a droplet or the like that attaches to the cap at the time of generating the liquid flow as compared with the case where the liquid flow is generated in a state in which the liquid ejecting head and the cap are in contact with each other.

Aspect 6

In a preferable example (Aspect 6) of any one of Aspects 1 to 5, at least one of a pressure in the inflow channel and a pressure in the outflow channel is changed stepwise. According to the aspect described above, the flow amount of the liquid flow can be changed stepwise by changing at least one of the pressure in the inflow channel and the pressure in the outflow channel stepwise. According to this, a flow of a different flow amount can be generated in accordance with a position in the liquid ejecting head at which stagnation of the liquid and bubbles have occurred. Therefore, stagnation of liquid in the liquid ejecting head can be appropriately suppressed, and bubbles can be more easily discharged.

Aspect 7

A liquid ejecting apparatus according to a preferable aspect (Aspect 7) includes a liquid ejecting head that has an inner space in which a liquid flows and that ejects the liquid in the inner space through a nozzle, an inflow channel through which the liquid flows into the inner space, an outflow channel through which the liquid in the inner space flows out, and a valve element that opens and closes the inflow channel, and opens the inflow channel by opening the valve element in accordance with a negative pressure on a downstream side of the valve element to generate a liquid flow from the inflow channel to the outflow channel through the inner space. A pressure on an upstream side of the valve element is increased more in a case where a flow amount of the liquid flow is larger. According to the aspect described above, a liquid flow can be generated in the liquid ejecting head by opening inflow channel by opening the valve element in accordance with a negative pressure on the downstream side of the valve element. At this time, although the negative pressure in the nozzle increases more in the case where the flow amount of the liquid flow is larger, the increase in the negative pressure in the nozzle can be reduced because the pressure on the upstream side of the valve element is increased more in the case where the flow amount of the liquid flow is larger. According to this, the breakage of the meniscus caused by the increase in the negative pressure in the nozzle can be suppressed even in the case where the flow amount of the liquid flow generated in the liquid ejecting head is increased.

Aspect 8

In a preferable example (Aspect 8) of Aspect 7, the valve element is opened by depressurizing the outflow channel. According to the aspect described above, the vale element is opened by depressurizing the outflow channel, thus the valve element is more likely to be opened and the flow amount of the liquid flow is more likely to increase.

Aspect 9

In a preferable example (Aspect 9) of Aspect 7 or 8, the liquid ejecting apparatus includes a flexible film for moving the valve element, the flexible film has a first surface that constitutes part of the inflow channel downstream of the valve element and a second surface opposite to the first surface, and the valve element is opened by deformation of the flexible film according to pressure difference between a pressure on the first surface and a pressure on the second surface. According to the aspect described above, the liquid flow by the first control can be performed by opening the valve element by deformation of the flexible film according to the pressure difference between the first surface and the second surface.

Aspect 10

In a preferable example (Aspect 10) of Aspect 9, the valve element is opened regardless of the pressure difference by deforming the flexible film by applying an external force to the second surface of the flexible film. According to the aspect described above, the valve element can be opened by deforming the flexible film regardless of the pressure difference by applying an external force to the second surface of the flexible film.

Aspect 11

In a preferable example (Aspect 11) of any one of Aspects 7 to 10, the liquid ejecting apparatus includes a cap that comes into contact with the liquid ejecting head to seal the nozzle, and the liquid flow from the inflow channel to the outflow channel through the inner space is generated by opening the inflow channel by opening the valve element in accordance with a negative pressure on a downstream side of the valve element in a state in which the liquid ejecting head and the cap are separated from each other. According to the aspect described above, since the liquid flow is generated in a state in which the liquid ejecting head and the cap are separated from each other, the meniscus of the nozzle can be less likely to be broken by a droplet or the like that attaches to the cap at the time of generating the liquid flow as compared with the case where the liquid flow is generated in a state in which the liquid ejecting head and the cap are in contact with each other.

Aspect 12

In a preferable example (Aspect 12) of any one of Aspects 7 to 11, a flow amount of the liquid flow is changed by changing at least one of a pressure in the inflow channel and a pressure in the outflow channel. According to the aspect described above, the flow amount of the liquid flow can be changed stepwise by changing at least one of the pressure in the inflow channel and the pressure in the outflow channel stepwise. According to this, a flow of a different flow amount can be generated in accordance with a position in the liquid ejecting head at which stagnation of the liquid and bubbles have occurred. Therefore, stagnation of liquid in the liquid ejecting head can be appropriately suppressed, and bubbles can be more easily discharged.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
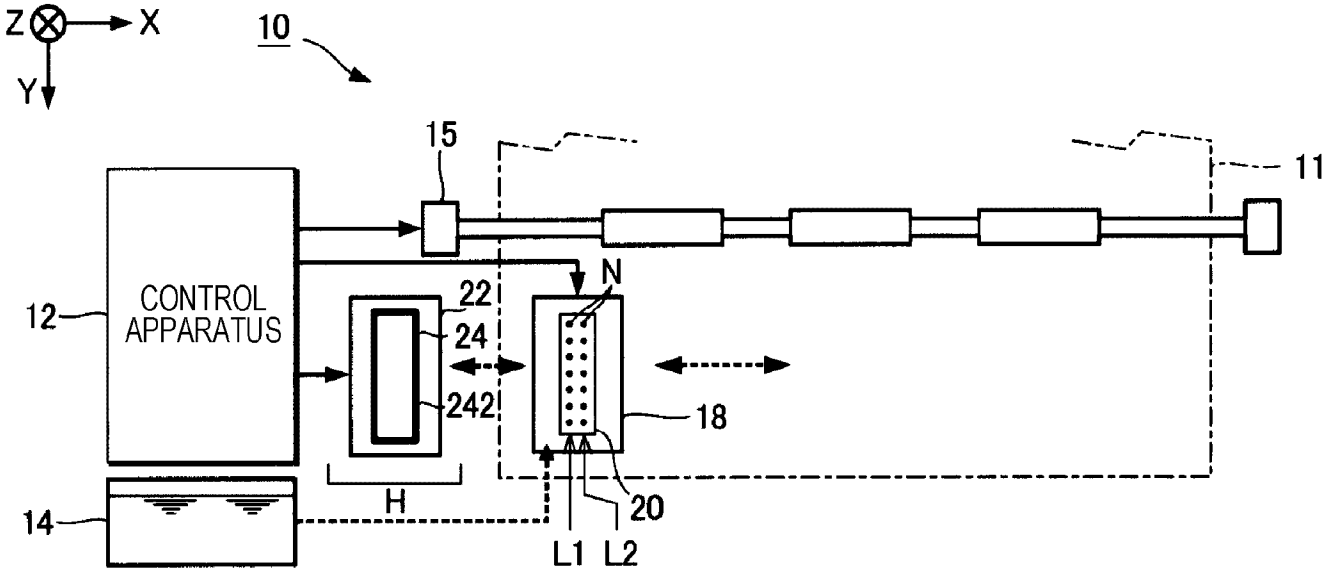
FIG. 1 illustrates a configuration of a liquid ejecting apparatus according to a first embodiment.

FIG. 1 illustrates a partial configuration of a liquid ejecting apparatus 10 according to a first embodiment of the invention. The liquid ejecting apparatus 10 of the first embodiment is a printing apparatus of an ink jet type that ejects an ink, which is an example of a liquid, onto a medium 11 such as a printing sheet. The liquid ejecting apparatus 10 shown in FIG. 1 includes a control apparatus 12, a transport mechanism 15, a carriage 18, a liquid ejecting head 20, and a maintenance unit 22. A liquid container 14 that accommodates an ink is attached to the liquid ejecting apparatus 10.

The liquid container 14 is a cartridge of an ink tank type constituted by a box-shaped container that is attachable to and detachable from a body of the liquid ejecting apparatus 10. To be noted, the liquid container 14 is not limited to a box-shaped container, and may be a cartridge of an ink pack type constituted by a bag-shaped container. The liquid container 14 accommodates an ink. The ink may be a black ink or a color ink. The ink accommodated in the liquid container 14 is pumped to the liquid ejecting head 20.

The control apparatus 12 performs overall control of elements of the liquid ejecting apparatus 10. The transport mechanism 15 transports the medium 11 in a Y direction under the control of the control apparatus 12. The liquid ejecting head 20 ejects the ink supplied from the liquid container 14 onto the medium 11 through a plurality of nozzles N under the control of the control apparatus 12. The plurality of nozzles N are formed on an ejecting surface that is opposed to the medium 11.

The liquid ejecting head 20 is mounted on the carriage 18. Although a case where one liquid ejecting head 20 is mounted on the carriage 18 is illustrated in FIG. 1 as an example, the number of liquid ejecting heads 20 is not limited to this, and a plurality of liquid ejecting heads 20 may be mounted on the carriage 18. The control apparatus 12 causes the carriage 18 to reciprocate in an X direction crossing the Y direction (orthogonal to the Y direction in FIG. 1). A desired image is formed on a surface of the medium 11 by the liquid ejecting head 20 ejecting an ink onto the medium 11 during transport of the medium 11 and reciprocation of the carriage 18. To be noted, the carriage 18 may mount a plurality of liquid ejecting heads 20. A direction perpendicular to an X-Y plane (plane parallel to the surface of the medium 11) is referred to as a Z direction.

The maintenance unit 22 is disposed in, for example, a non-printing region H that serves as a home position (standby position) of the carriage 18 in the X direction. The maintenance unit 22 performs a maintenance process of the liquid ejecting head 20 when the carriage 18 is in the non-printing region H. The maintenance unit 22 includes a capping mechanism 24 controlled by the control apparatus 12.

The capping mechanism 24 is used when capping the ejecting surface of the liquid ejecting head 20. The capping mechanism 24 includes a cap 242 that seals the nozzles N of the ejecting surface. The cap 242 is formed in a box shape opening on the −Z side thereof. The nozzles N of the ejecting surface are sealed as a result of an edge portion of the opening of the cap 242 coming into contact with the ejecting surface. The cap 242 can be moved, by a motor (not illustrated), toward the −Z side on which the cap 242 comes into contact with the ejecting surface or toward the +Z side on which the cap 242 moves away from the ejecting surface. The control apparatus 12 brings the cap 242 into contact with the ejecting surface and thus seals the nozzles N. At this time, a thickening ink and bubbles can be discharged onto the cap 242 by sucking these through the nozzles N by a pump (not illustrated) communicating with the cap 242. The ink discharged onto the cap 242 is discarded, through a flow channel communicating with the cap 242, to a waste liquid tank that is not illustrated.

Examples of the maintenance process of the liquid ejecting head 20 include a cleaning process and a flushing process of the liquid ejecting head 20. The cleaning process is a maintenance process of forcibly discharging an ink from the nozzles N by the pump (not illustrated) communicating with the cap 242. The flushing process is a maintenance process of causing the nozzles N to eject an ink by applying an ejecting waveform to a piezoelectric element. By discharging the thickening ink and bubbles through the nozzles N by performing a maintenance process such as the cleaning process or the flushing process, clogging and ejection failure of the nozzles N can be suppressed.

Figure 2:
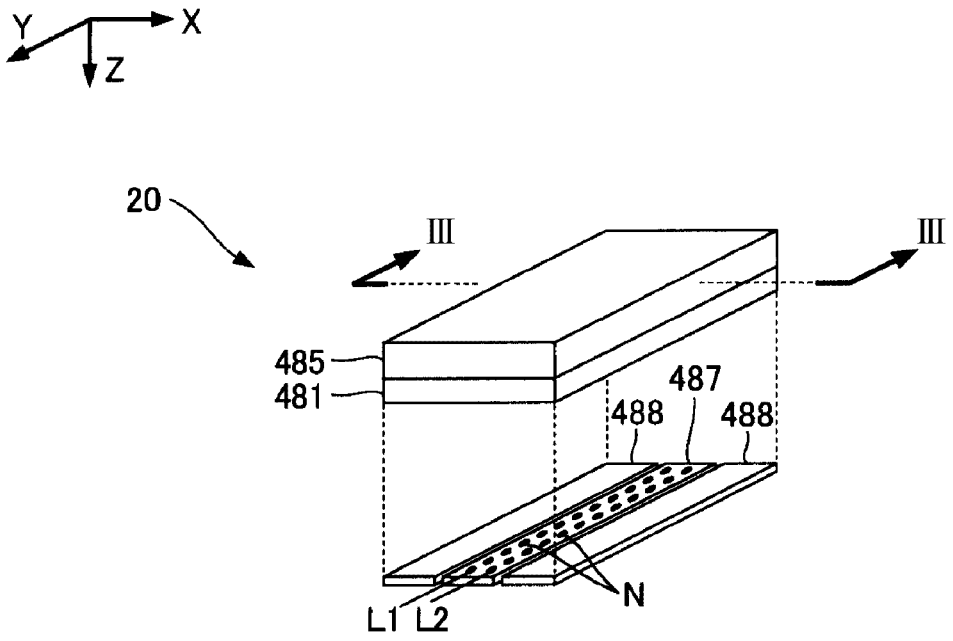
FIG. 2 is an exploded perspective view of a liquid ejecting head.
Figure 3:
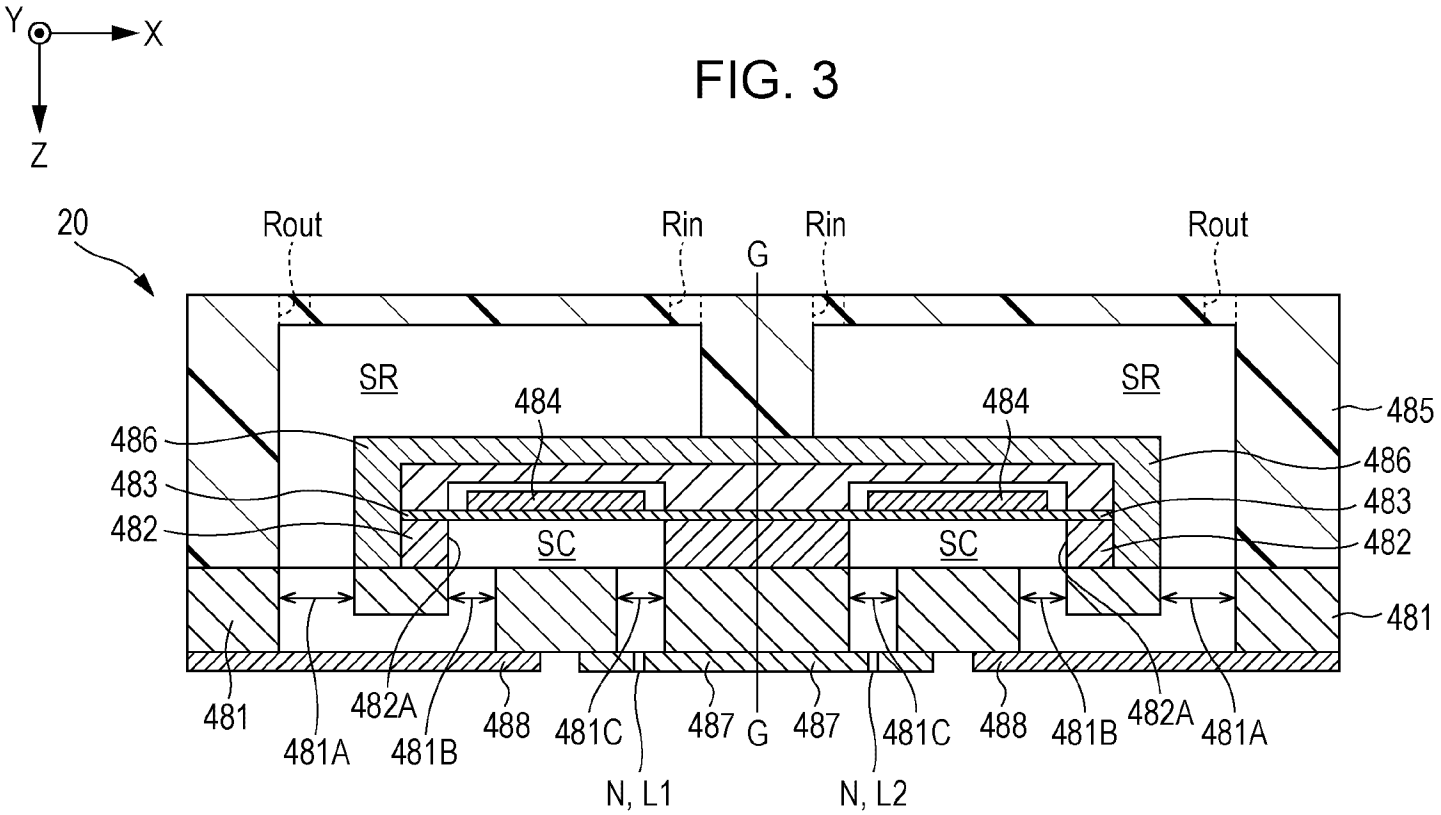
FIG. 3 is a section view of the liquid ejecting head illustrated in FIG. 2 taken along a line III-III.

FIG. 2 is an exploded perspective view of the liquid ejecting head 20. FIG. 3 is a section view of the liquid ejecting head 20 illustrated in FIG. 2 taken along a line III-III. As illustrated in FIGS. 2 and 3, the liquid ejecting head 20 ejects an ink supplied from the liquid container 14 through the plurality of nozzles N. The liquid ejecting head 20 is a structure in which a pressure chamber substrate 482, a diaphragm 483, piezoelectric elements 484, a housing portion 485, and a sealing element 486 are disposed on one side of a channel substrate 481 and a nozzle plate 487 and a buffer plate 488 are disposed on the other side of the channel substrate 481. The channel substrate 481, the pressure chamber substrate 482, and the nozzle plate 487 are each constituted by, for example, a silicon material having a flat plate shape, and the housing portion 485 is formed by, for example, injection molding of a resin material. The plurality of nozzles N are formed in the nozzle plate 487. A surface of the nozzle plate 487 not facing the channel substrate 481 corresponds to the ejecting surface (surface of the liquid ejecting head 20 facing the medium 11).

The plurality of nozzles N can be divided into a first nozzle row L1 and a second nozzle row L2. The first nozzle row L1 and the second nozzle row L2 are each a group of a plurality of nozzles arranged along the Y direction. The first nozzle row L1 and the second nozzle row L2 are arranged parallel with an interval in the X direction therebetween. To be noted, positions of nozzles N of the first nozzle row L1 and nozzles N of the second nozzle row L2 may be varied in the Y direction (so-called staggered arrangement).

As illustrated in FIG. 3, in the liquid ejecting head 20 of the present embodiment, a structure (left part in FIG. 3) corresponding to the first nozzle row L1 and a structure (right part in FIG. 3) corresponding to the second nozzle row L2 are formed in substantially line symmetry with respect to a virtual line G-G extending in the Z direction, and the two structures are substantially the same. Therefore, description below will be given by mainly focusing on the structure corresponding to the first nozzle row L1 (part to the left of the virtual line G-G of FIG. 3).

In the channel substrate 481, an opening portion 481A, branching channels 481B, and communicating channels 481C are defined. Each of the branching channels 481B and the communicating channels 481C is a through hole defined for each nozzle N, and the opening portion 481A is an opening continuous over the plurality of nozzles N. The buffer plate 488 is a flat plate material (compliance substrate) that is disposed on a surface of the channel substrate 481 not facing the pressure chamber substrate 482 and closes the opening portion 481A. Pressure change in the opening portion 481A is absorbed by the buffer plate 488.

In the housing portion 485, a common liquid chamber SR (reservoir) communicating with the opening portion 481A of the channel substrate 481 is formed. The common liquid chamber SR on the left side of FIG. 3 is a space in which the ink to be supplied to the plurality of nozzles N constituting the first nozzle row L1 is to be stored, and is continuous over these nozzles N. The common liquid chamber SR on the right side of FIG. 3 is a space in which the ink to be supplied to the plurality of nozzles N constituting the second nozzle row L2 is to be stored, and is continuous over these nozzles N. In each common liquid chamber SR, an inflow port Rin through which an ink supplied from the upstream side flows in and an outflow port Rout through which the ink flows out toward the downstream side are defined.

In the pressure chamber substrate 482, an opening portion 482A is defined for each nozzle N. The diaphragm 483 is a flat plate material that is disposed on a surface of the pressure chamber substrate 482 not facing the channel substrate 481 and is capable of elastically deforming. A space in each opening portion 482A of the pressure chamber substrate 482 enclosed by the diaphragm 483 and the channel substrate 481 functions as a pressure chamber (cavity) SC in which the ink supplied from the common liquid chamber SR through the branching channel 481B is injected. Each pressure chamber SC communicates with a nozzle N through a communicating channel 481C of the channel substrate 481.

On the surface of the diaphragm 483 not facing the pressure chamber substrate 482, a piezoelectric element 484 is formed for each nozzle N. The piezoelectric elements 484 are each a driving element in which a piezoelectric body is interposed between two opposing electrodes. In the case where the diaphragm 483 vibrates as a result of the piezoelectric elements 484 deforming due to a supplied driving signal, the pressure in the pressure chamber SC changes and the ink in the pressure chamber SC is ejected through a nozzle N. The sealing element 486 protects the plurality of piezoelectric elements 484. To be noted, the piezoelectric elements 484 are connected to the control apparatus 12 via a flexible printed circuit (FPC) or a chip on film (COF) that is not illustrated.

Figure 4:
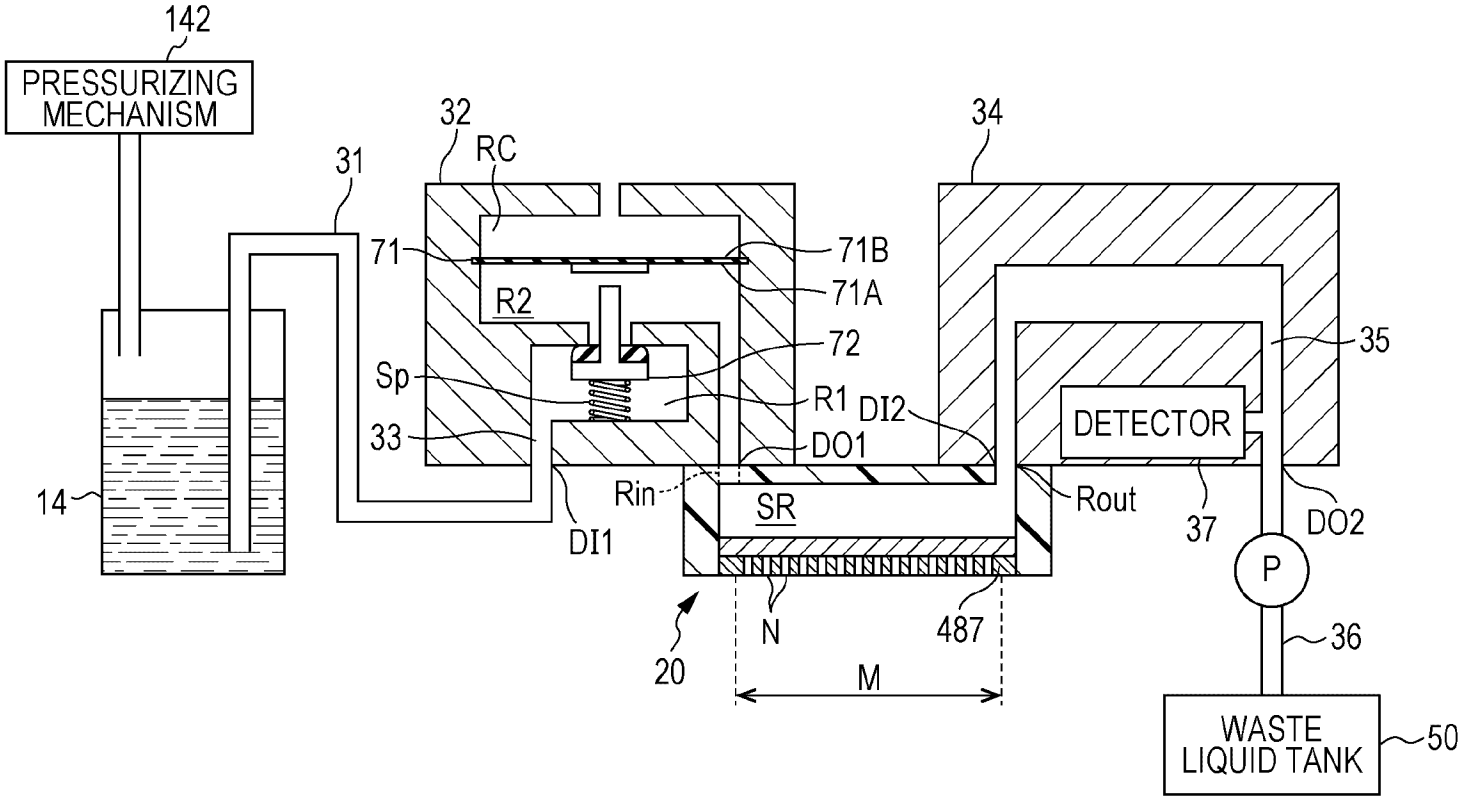
FIG. 4 is a diagram for describing a channel configuration of the liquid ejecting head.

FIG. 4 is a diagram for describing a channel configuration of the liquid ejecting head 20. The liquid ejecting apparatus 10 of the present embodiment can suppress precipitation of components of the ink or the like by generating an ink flow in the liquid ejecting head 20. Such an ink flow may be generated during printing, in a printing standby state, or during cleaning of the liquid ejecting head 20. In addition, the ink flow may be generated intermittently at certain intervals. The common liquid chamber SR of the present embodiment functions as an inner space of the liquid ejecting head 20 in which the ink flows, and a case where an ink flow is generated in the common liquid chamber SR will be described as an example in the present embodiment. FIG. 4 is a simplified section view of the structure corresponding to the first nozzle row L1 of the liquid ejecting head 20 taken along a Y-Z plane. The channel configuration of the structure corresponding to the second nozzle row L2 is similar, so detailed description thereof will be omitted herein.

In the channel configuration of FIG. 4, an upstream channel member 32 is provided upstream of the liquid ejecting head 20, and a downstream channel member 34 is provided downstream of the liquid ejecting head 20. The upstream channel member 32 is a channel structure in which an inflow channel 33 is formed. The inflow channel 33 is a flow channel through which the ink in the liquid container 14 flows into the liquid ejecting head 20. An ink inlet DI1 of the inflow channel 33 is connected to a supply channel 31 communicating with the liquid container 14. An ink outlet DO1 of the inflow channel 33 is connected to the inflow port Rin of the common liquid chamber SR. The liquid container 14 is connected to a pressurizing mechanism 142 for pressurizing and transferring (pumping) the ink in the liquid container 14. The pressurizing mechanism 142 of the present embodiment is constituted by an air pump. The inside of the liquid container 14 is pressurized by air from the air pump, and the ink in the liquid container 14 is pumped into the inflow channel 33 through the supply channel 31. Therefore, the pressure in the inlet DI1 of the inflow channel 33 (pressure on the upstream side of a valve element 72) can be adjusted by the pressurizing mechanism 142. To be noted, the pressurizing mechanism 142 is not limited to the air pump, and may be a liquid transfer pump provided in the supply channel 31 or an elevating mechanism that adjusts the head pressure of the ink in the liquid container 14 by moving up and down the liquid container 14.

The downstream channel member 34 is a channel structure in which an outflow channel 35 is formed. The outflow channel 35 is a flow channel through which the ink in the liquid ejecting head 20 flows out. An ink inlet DI2 of the outflow channel 35 is connected to the outflow port Rout of the common liquid chamber SR. An ink outlet DO2 of the outflow channel 35 is connected to a discharge channel 36 communicating with the waste liquid tank 50. The discharge channel 36 is a flow channel for discharging the ink in the common liquid chamber SR to the waste liquid tank 50. A liquid transfer pump P is provided in the discharge channel 36. The liquid transfer pump P functions as a pump for generating an ink flow. The liquid transfer pump P of the present embodiment is constituted by a depressurizing pump capable of adjusting pressure. Therefore, by adjusting the pressure in the outlet DO2 of the outflow channel 35 by the liquid transfer pump P, the amount of ink flow (flow amount of the ink flow generated in the liquid ejecting head 20) can be adjusted.

In the outflow channel 35, a detector 37 for detecting the flow amount or pressure of the ink flowing in the outflow channel 35 is provided. In the case of detecting the flow amount of ink flowing in the outflow channel 35, the detector 37 is constituted by a flowmeter, and in the case of detecting the pressure in the outflow channel 35, the detector 37 is constituted by a manometer. As described above, the flow amount of ink in the outflow channel 35 may be directly detected by constituting the detector 37 by a flowmeter, or may be indirectly detected from the pressure in the outflow channel 35 by constituting the detector 37 by a manometer. In the case of indirectly measuring the flow amount of ink by a manometer, for example, the relationship between the pressure and flow amount in the outflow channel 35 is measured in advance, and the flow amount of ink is obtained from the pressure detected by the manometer on the basis of the relationship between the pressure and flow amount. To be noted, in the case of detecting the flow amount of ink by the detector 37, the detector 37 may be provided in the inflow channel 33 or the supply channel 31.

A valve device 70 (self-sealing valve) is provided in the upstream channel member 32. The valve device 70 of the present embodiment is opened by pressure difference between the pressure on the downstream side and the atmospheric pressure. The valve device 70 includes an upstream channel R1 and a downstream channel R2 constituting part of the inflow channel 33. The upstream channel R1 is connected to the supply channel 31. A valve element 72 is disposed between the upstream channel R1 and the downstream channel R2. The downstream channel R2 is adjacent to an atmospheric pressure chamber RC communicating with the air. A flexible film 71 is interposed between the downstream channel R2 and the atmospheric pressure chamber RC, and the flexible film 71 partition the downstream channel R2 from the atmospheric pressure chamber RC. The flexible film 71 is an elastic film having flexibility, and is constituted by, for example, plastic, rubber, and fiber.

The valve element 72 opens and closes the inflow channel 33. Specifically, the valve element 72 lets the upstream channel R1 and the downstream channel R2 communicate with each other (open state) or blocks the upstream channel R1 and the downstream channel R2 from each other (closed state). The valve element 72 is provided with a spring Sp that urges the valve element 72 toward the direction in which the upstream channel R1 and the downstream channel R2 are blocked from each other. Therefore, when no force is applied to the valve element 72, the upstream channel R1 and the downstream channel R2 are blocked from each other. However, in the case where a force is applied to the valve element 72 against the urging force of the spring Sp and the valve element 72 is moved toward the +Z side, the upstream channel R1 and the downstream channel R2 communicate with each other.

In the case where the pressure in the downstream channel R2 is decreased to reach a predetermined negative pressure due to ejection and suction of ink by the liquid ejecting head 20, the valve element 72 is opened. The opening operation of the valve element 72 corresponds to the valve element 72 moving downward (toward the +Z side) against the urging force of the spring Sp so as to let the upstream channel R1 and the downstream channel R2 communicate with each other. That is, in the case where the surface of the flexible film 71 constituting part of the downstream channel R2 is referred to as a first surface 71A and the surface on the atmospheric pressure chamber RC side opposite to the first surface 71A is referred to as a second surface 71B, the valve element 72 moves when the flexible film 71 is deformed in accordance with a pressure difference between the pressure (negative pressure) on the first surface 71A and the pressure (atmospheric pressure) on the second surface 71B. The valve element 72 is opened when the pressure in the downstream channel R2 reaches a predetermined negative pressure with respect to the atmospheric pressure, the upstream channel R1 and the downstream channel R2 communicate with each other and thus the inflow channel 33 opens. To be noted, although a case where the valve element 72 is configured to open and close in accordance with the pressure difference between the pressure on the first surface 71A and the pressure on the second surface 71B of the flexible film 71 has been described as an example in the present embodiment, the valve element 72 may be configured to open and close in accordance with the pressure difference between the pressure in the upstream channel R1 and the pressure in the downstream channel R2.

According to such a channel configuration of the present embodiment, by driving the liquid transfer pump P, the downstream side of the valve element 72 is depressurized and the valve element 72 is opened to open the inflow channel 33, and thus an ink flow in which the ink in the liquid container 14 flows from the inflow channel 33 to the outflow channel 35 through the common liquid chamber SR can be generated. Specifically, when the liquid transfer pump P is driven, the pressure in the outlet DO2 of the outflow channel 35 decreases to be a negative pressure, and thus the pressure in the downstream channel R2 communicating with the outflow channel 35 through the common liquid chamber SR also becomes a negative pressure. The flexible film 71 deforms due to the pressure difference between this negative pressure and the atmospheric pressure, and the valve element 72 opens when the pressure reaches the predetermined negative pressure. As a result of this, the valve element 72 opens to open the inflow channel 33, and the ink in the liquid container 14 flows from the inflow channel 33 to the outflow channel 35 through the common liquid chamber SR, and is discharged to the waste liquid tank 50 through the discharge channel 36.

As described above, by generating an ink flow in the common liquid chamber SR in the liquid ejecting head 20, precipitation of components of ink in the common liquid chamber SR can be suppressed, bubbles stagnating in the common liquid chamber SR can be discharged, and stagnation of the bubbles can be suppressed by eliminating stagnation of the ink. Although the common liquid chamber SR has been shown as an example of an inner space in the liquid ejecting head 20 in which an ink flow is generated in the present embodiment, the inner space is not limited to this, and an ink flow may be generated in each pressure chamber SC as the inner space.

To be noted, although a case where the ink to flow in the liquid ejecting head 20 is discharged to the waste liquid tank 50 has been described as an example in the present embodiment, the ink may be discharged to and stored in a replacing ink tank instead of the waste liquid tank 50. The replacing ink tank filled with the ink can replace an ink tank constituting the liquid container 14 to reuse the ink. In addition, in the case where the liquid container 14 is constituted by an ink pack, the pressurizing mechanism 142 is constituted by a pump that adjusts the pressure to be applied to the ink pack.

Incidentally, in a configuration in which the valve element 72 is opened on the basis of a negative pressure on the downstream side of the valve element 72 as in the present embodiment, the flow amount of the ink flow generated in the liquid ejecting head 20 can be increased more by increasing the negative pressure on the downstream side of the valve element 72 more. However, in the case where the negative pressure on the downstream side of the valve element 72 is increased more, there is a higher possibility that the meniscus in the nozzles N is broken because the negative pressure in the nozzles N increases more.

Therefore, in the present embodiment, the pressure on the upstream side of the valve element 72 is increased more in the case where the flow amount (ink flow amount) of the ink flow generated in the liquid ejecting head 20 is larger. As a result of this, the increase in the negative pressure in the nozzles N can be reduced. According to this, the breakage of the meniscus caused by the increase in the negative pressure in the nozzles N can be suppressed even in the case where the flow amount of the ink flow generated in the liquid ejecting head 20 is increased.

Figure 5:
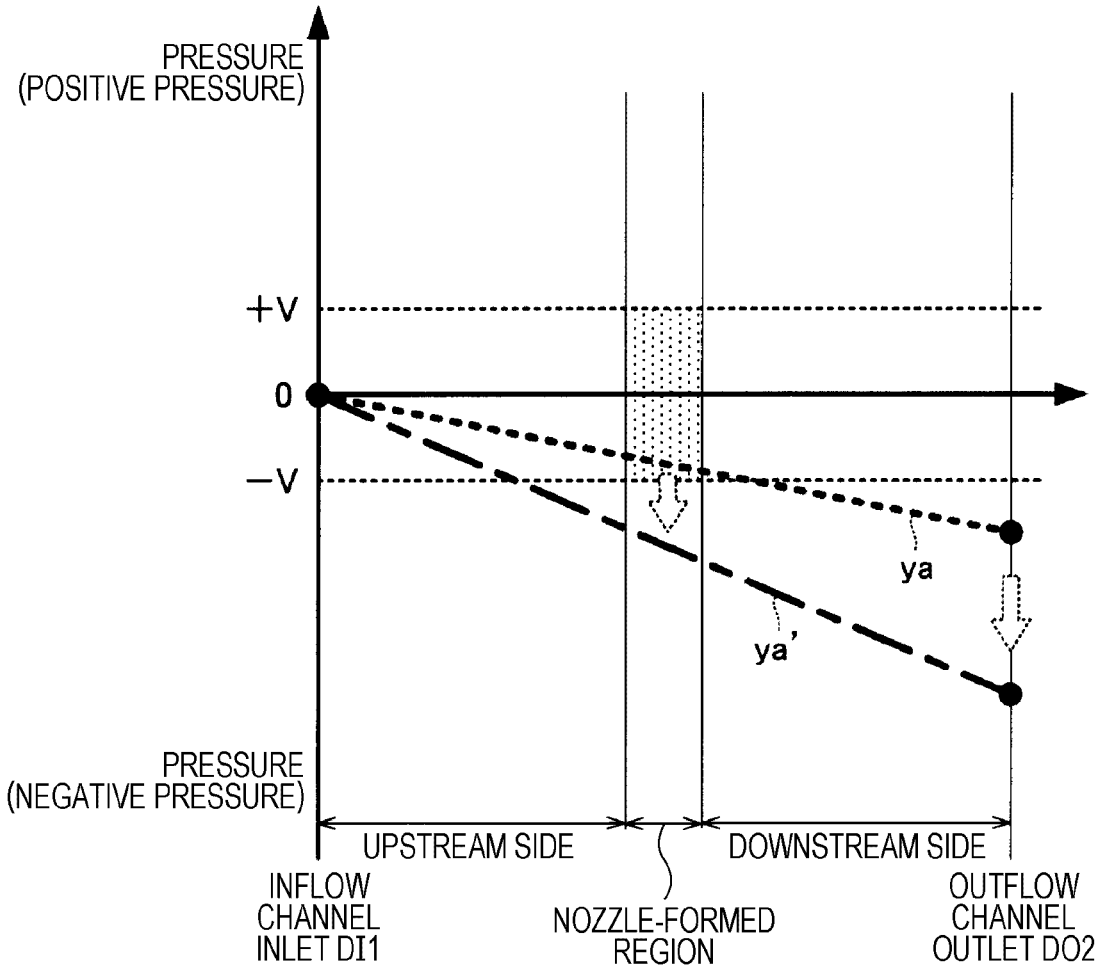
FIG. 5 is a graph illustrating pressure change in a comparative example.
Figure 6:
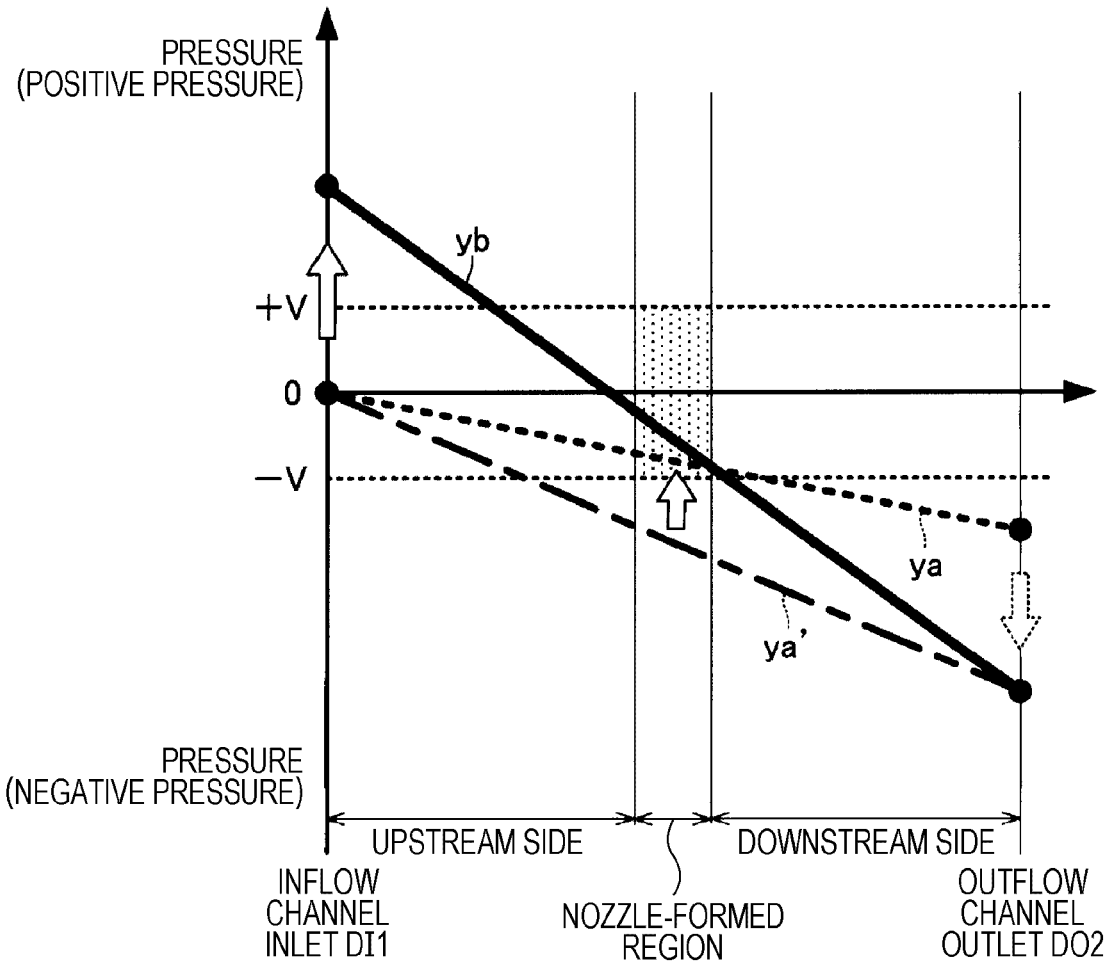
FIG. 6 is a graph illustrating pressure change in the first embodiment.

The principle of suppressing the breakage of the meniscus by increasing the pressure on the upstream side of the valve element 72 will be described in detail below. In the present embodiment, a case where the pressure in the inlet DI1 of the inflow channel 33 is increased as the pressure on the upstream side of the valve element 72 will be described as an example. FIGS. 5 and 6 are each a graph illustrating change in pressure in the channel in which the ink flow is generated, and the pressure at each position in the channel in which the ink flow is generated is approximated by a straight line therein. FIG. 5 shows a comparative example in which the pressure in the inlet DI1 of the inflow channel 33 is not increased, and FIG. 6 shows the present embodiment in which the pressure in the inlet DI1 of the inflow channel 33 is increased. The vertical axes of FIGS. 5 and 6 each represent pressure, and above the pressure "0" corresponds to a positive pressure and below the pressure "0" corresponds to a negative pressure. The horizontal axes each represent the position in which the ink flow is generated, and indicates a flow channel from the inlet DI1 of the inflow channel 33 on the upstream side to the outlet DO2 of the outflow channel 35 on the downstream side through the liquid ejecting head 20. A "nozzle-formed region" in FIGS. 5 and 6 corresponds to a region M in which the plurality of nozzles N illustrated in FIG. 4 are formed, and is substantially the same as the region of the common liquid chamber SR is formed.

Figure 8:
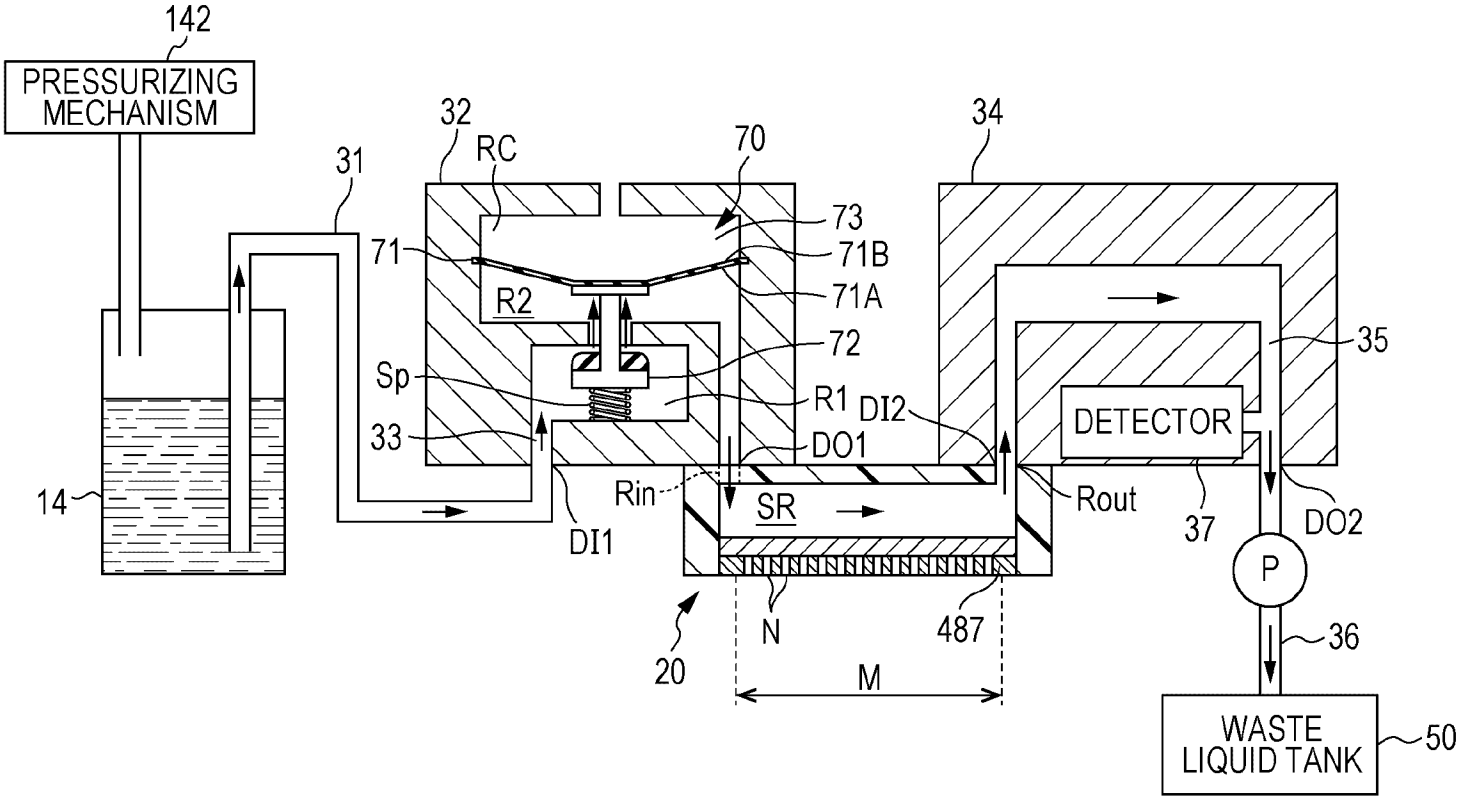
FIG. 8 is a diagram for describing an opening operation of a valve element in the first embodiment.

In FIGS. 5 and 6, the "nozzle-formed region" is placed at the center, and the graph can be roughly divided into the upstream side and the downstream side of the "nozzle-formed region". The greater the inclination of the graph of FIGS. 5 and 6 is, the greater the flow amount of ink is, and the smaller the inclination of the graph of FIG. 8 is, the smaller the flow amount of ink is. Therefore, the inclination of the graph of FIGS. 5 and 6 corresponds to the flow amount of ink. In addition, in FIGS. 5 and 6, an upper limit and a lower limit of a meniscus holding pressure (pressure in which the meniscus is not broken) of the nozzles N are respectively indicated by +V (positive pressure side) and −V (negative pressure side). Therefore, the meniscus is not broken while the pressure of the "nozzle-formed region" is within the range from −V to +V in the graph of FIGS. 5 and 6, and the meniscus is broken when the pressure becomes below −V.

A graph ya of FIG. 5 is a graph before the pressure in the outlet DO2 of the outflow channel 35 is decreased, and a graph ya' is a graph after the flow amount of ink is increased by decreasing the pressure in the outlet DO2 of the outflow channel 35 without changing the pressure in the inlet DI1 of the inflow channel 33. A graph yb of FIG. 6 is a graph after the pressure in the inlet DI1 of the inflow channel 33 is increased while decreasing the pressure in the outlet DO2 of the outflow channel 35. The graphs ya and ya' of FIG. 5 are superposed on FIG. 6.

According to FIG. 5, as indicated by a blank arrow of a dotted line, the more the pressure in the outlet DO2 of the outflow channel 35 is decreased to a greater negative pressure, the greater the inclination of the pressure change becomes as in the change from the graph ya to the graph ya', and thus the flow amount of ink can be increased more. However, the greater the negative pressure in the outlet DO2 of the outflow channel 35 becomes, that is, the larger the flow amount of ink becomes, the greater the negative pressure in the nozzles N becomes. Therefore, the pressure of the "nozzle-formed region" becomes more likely to be below the meniscus holding pressure (−V) as the graph ya' and the meniscus is broken.

In contrast, in the graph yb of FIG. 6, the pressure on the upstream side of the valve element 72 is increased by pressurizing the inlet DI1 of the inflow channel 33 as indicated by a blank arrow of a solid line while decreasing the pressure in the outlet DO2 of the outflow channel 35 as indicated by the blank arrow of the dotted line. As a result of this, the increase of the negative pressure in the nozzle N can be reduced such that the pressure of the "nozzle-formed region" does not become below the meniscus holding pressure (−V), and thus the breakage of the meniscus caused by the increase in the negative pressure in the nozzles N can be suppressed even in the case where the flow amount of ink is increased. As described above, the breakage of the meniscus can be suppressed by increasing the pressure on the upstream side of the valve element 72 even in the case where the flow amount of the ink flow generated in the liquid ejecting head 20 is increased.

Figure 7:
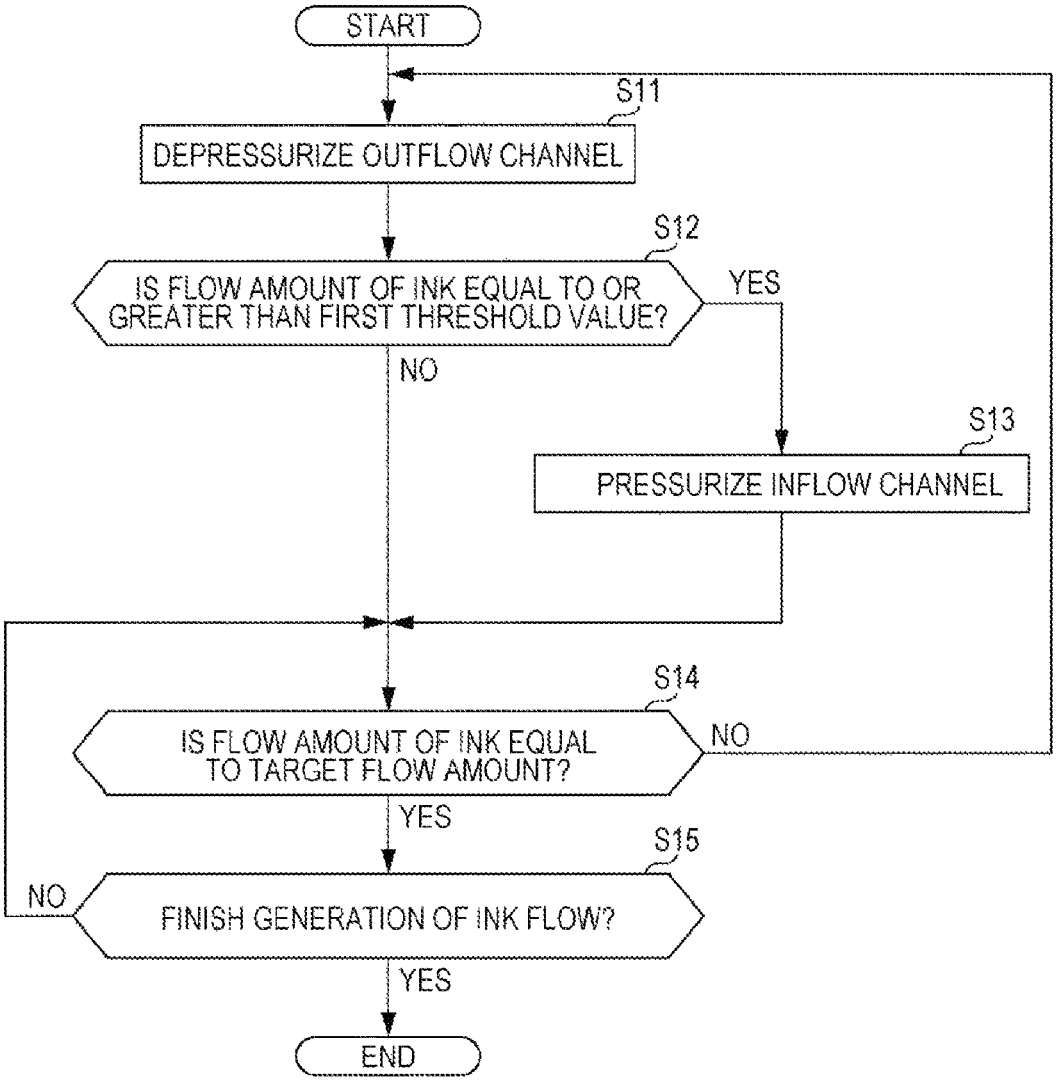
FIG. 7 is a flowchart illustrating a control method of the liquid ejecting apparatus according to the first embodiment.

Next, a control method of the liquid ejecting apparatus 10 for generating an ink flow in the liquid ejecting head 20 by using the principle described above will be described. FIG. 7 is a flowchart illustrating a control method of the liquid ejecting apparatus 10 for generating an ink flow in the first embodiment. FIG. 8 is a diagram for describing an opening operation of the valve element 72.

As illustrated in FIG. 7, first, the control apparatus 12 opens the valve element 72 and thus generates an ink flow in the common liquid chamber SR by depressurizing the outflow channel 35 in step S11. Specifically, by making the pressure (pressure in the downstream channel R2) in the outlet DO2 of the outflow channel 35 a negative pressure by driving the liquid transfer pump P, the valve element 72 is opened to open the inflow channel 33 by deformation of the flexible film 71 due to the pressure difference between the negative pressure and the atmospheric pressure. As a result of this, the valve element 72 opens as illustrated in FIG. 8, and the ink flow from the inflow channel 33 to the outflow channel 35 through the common liquid chamber SR is generated. In addition, the flow amount of the ink flow increases more in the case where the negative pressure in the outlet DO2 of the outflow channel 35 is greater. As described above, by opening the valve element 72 by depressurizing the outflow channel 35, the valve element 72 becomes more likely to open, and the flow amount of the ink flow is more likely to increase.

Next, in step S12, the control apparatus 12 determines whether or not the flow amount of ink is above a first threshold value. Specifically, the control apparatus 12 determines whether or not the flow amount of ink in the outflow channel 35 detected by the detector 37 is above the first threshold value. Here, the first threshold value is such a flow amount that the pressure of the "nozzle-formed region" is out of the range of the meniscus holding pressure (from −V to +V) when the flow amount of ink is above the first threshold value, or a flow amount larger than this flow amount by a certain margin. Specifically, in the present embodiment, by increasing the flow amount of ink by depressurizing the outflow channel 35 without pressurizing the inflow channel 33, the pressure of the "nozzle-formed region" becomes greater toward the negative pressure side and the pressure of the "nozzle-formed region" becomes below the meniscus holding pressure (−V) as indicated by the blank arrow of a dotted line of FIG. 5. Therefore, in the present embodiment, in the case where the outflow channel 35 is depressurized without pressurizing the inflow channel 33, the flow amount such that the pressure of the "nozzle-formed region" becomes below the meniscus holding pressure or the flow amount larger than this flow amount by a certain margin is set as the first threshold value.

In the case where the control apparatus 12 has determined that the flow amount of ink is not above the first threshold value in step S12 (NO), the control apparatus 12 determines whether or not the flow amount of ink has reached a predetermined target flow amount in step S14. Specifically, the control apparatus 12 determines whether or not the flow amount of ink in the outflow channel 35 detected by the detector 37 has reached the target flow amount. The target flow amount herein is a flow amount aimed for at the time of generating the ink flow. In the case where the control apparatus 12 has determined that the flow amount of ink has not reached the target flow amount in step S14 (NO), the process returns to step S11, and the outflow channel 35 is further depressurized to increase the flow amount of ink.

In the case where the control apparatus 12 has determined that the flow amount of ink is above the first threshold value in step S12 (YES), the control apparatus 12 pressurizes the inflow channel 33 in step S13, and determines whether or not the flow amount of ink has reached the target flow amount in step S14. Specifically, the control apparatus 12 pressurizes the inflow channel 33 by the pressurizing mechanism 142 to increase the pressure in the inlet DI1 of the inflow channel 33. In the case where the pressure in the inlet DI1 of the inflow channel 33 is "0" or "a negative pressure", the pressure in the inlet DI1 of the inflow channel 33 is changed to "a positive pressure" as indicated by the blank arrow of a solid line of FIG. 6. As a result of this, the flow amount can be increased, and the increase in the negative pressure in the "nozzle-formed region" of FIG. 6 can be reduced such that the pressure of the "nozzle-formed region" is not below the meniscus holding pressure (−V). Therefore, the breakage of the meniscus caused by the increase in the negative pressure in the nozzles N can be suppressed even in the case where the flow amount of the ink flow generated in the liquid ejecting head 20 is increased.

In the case where the control apparatus 12 has determined that the flow amount of ink has reached the target flow amount in step S14 (YES), the control apparatus 12 determines whether or not to finish generation of the ink flow in step S15. In the case where the control apparatus 12 has determined not to finish the generation of ink flow in step S15 (NO), the process returns to step S14. By returning to step S14, the control apparatus 12 monitors the flow amount of ink until the generation of ink flow is finished. In the case where the control apparatus 12 has determined to finish the generation of ink flow in step S15 (YES), the control apparatus 12 stops the liquid transfer pump P and finishes the control of generating an ink flow.

As described above, according to the control of the first embodiment, in the case of generating an ink flow in the liquid ejecting head 20, the flow amount of ink is increased by depressurizing the outflow channel 35, the inflow channel 33 is pressurized when the flow amount of ink becomes above the first threshold value, and therefore the pressure on the upstream side of the valve element 72 can be increased more in the case where the flow amount of ink is larger. According to this, the breakage of the meniscus caused by the increase in the negative pressure in the nozzles N can be suppressed even in the case where the flow amount of ink is increased. In addition, since the inflow channel 33 is pressurized when the flow amount of ink is above the first threshold value, the inlet DI1 of the inflow channel 33 can be pressurized as indicated by the blank arrow of a solid line of FIG. 6 even in the case where the pressure of the "nozzle-formed region" is still below the meniscus holding pressure (−V) when the outlet DO2 of the outflow channel 35 is depressurized as indicated by the blank arrow of a dotted line of FIG. 5. According to this, the flow amount can be increased while suppressing the breakage of the meniscus.

To be noted, a plurality of threshold values may be set as the first threshold value, and the pressure in the inlet DI1 of the inflow channel 33 may be increased stepwise in accordance with the flow amount of ink. In addition, the first threshold value may be changed stepwise in accordance with the pressure in the inlet DI1 of the inflow channel 33 and the pressure in the outlet DO2 of the outflow channel 35. As shown in FIG. 6, the flow amount such that the pressure of the "nozzle-formed region" does not become below the meniscus holding pressure (−V) changes in accordance with the pressure in the inlet DI1 of the inflow channel 33 and the pressure in the outlet DO2 of the outflow channel 35. By changing the first threshold value stepwise, the flow amount of ink can be gradually increased while suppressing the breakage of the meniscus.

In addition, the flow amount of ink generated in the liquid ejecting head 20 may be changeable in a stepwise manner. By changing at least one of the pressure in the inflow channel 33 (pressure on the upstream side of the valve element 72) and the pressure in the outflow channel 35 stepwise, the flow amount of ink can be changed stepwise. According to this, a flow of a different flow amount can be generated in accordance with a position in the liquid ejecting head 20 at which stagnation of the ink and bubbles have occurred. Therefore, stagnation of ink in the liquid ejecting head 20 can be appropriately suppressed, and bubbles can be more easily discharged.

Figure 9:
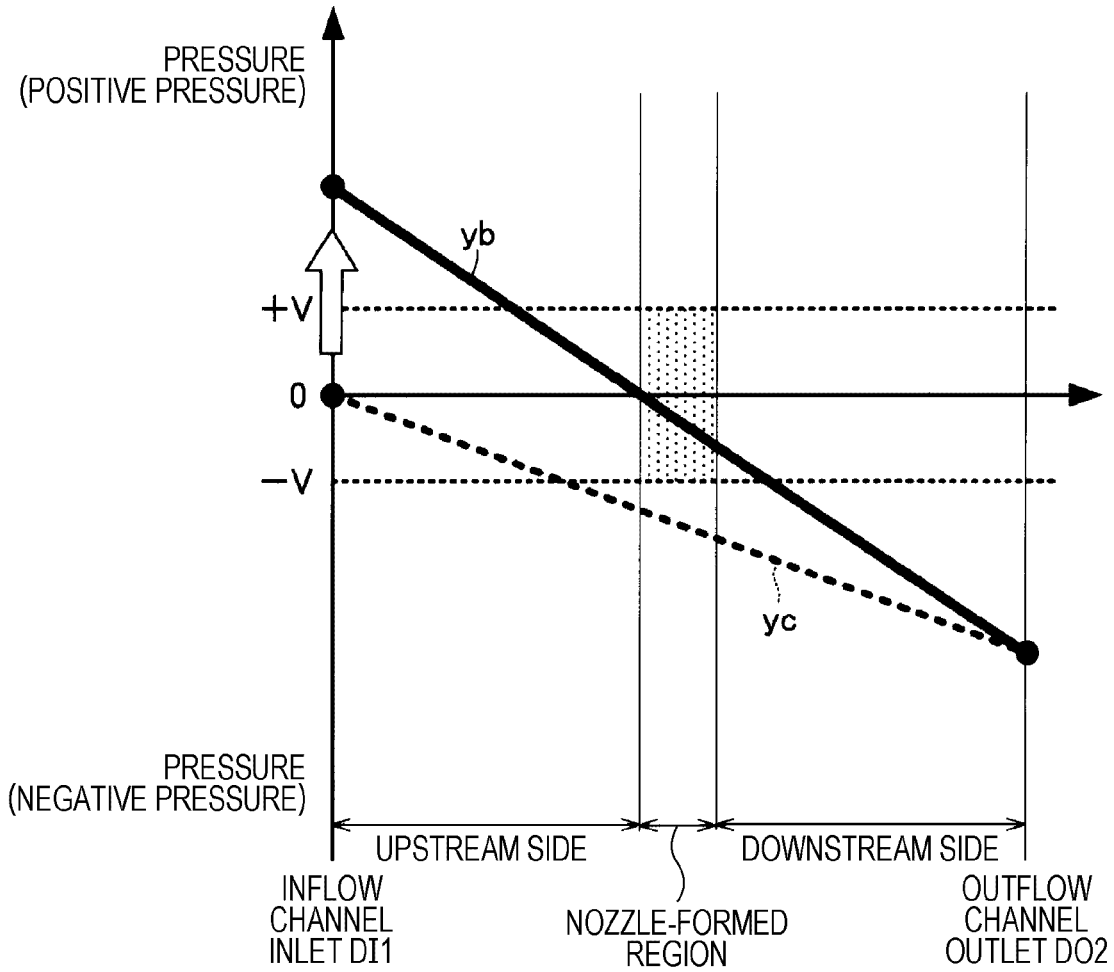
FIG. 9 is a graph illustrating pressure change in a first modification of the first embodiment.

In addition, although a case where the flow amount of ink is increased by depressurizing the outflow channel 35 has been described as an example in the first embodiment, the configuration is not limited to this, and the flow amount of ink may be increased by pressurizing the inlet DI1 of the inflow channel 33 as indicated by a blank arrow of a solid line of FIG. 9 while keeping the pressure in the outlet DO2 of the outflow channel 35 constant as in a first modification of the first embodiment illustrated in FIG. 9. FIG. 9 is a graph illustrating change in pressure in the channel in which the ink flow is generated in the first modification of the first embodiment, and the pressure at each position in the channel in which the ink flow is generated is approximated by a straight line therein. In FIG. 9, a graph yb shows pressure change in the case where the pressure in the inlet DI1 of the inflow channel 33 is a positive pressure in the first modification, and a graph yc shows pressure change in the case where the pressure in the inlet DI1 of the inflow channel 33 is "0" in a comparative example. The pressure in the outlet DO2 of the outflow channel 35 is the same in the graph yb and the graph yc.

Also in the case where the pressure in the outlet DO2 of the outflow channel 35 is kept constant, the flow amount of ink can be increased more in the case where the constant pressure is lower. However, as in the graph yc of the comparative example of FIG. 9, in the case where the pressure in the outlet DO2 of the outflow channel 35 is decreased more, the negative pressure in the "nozzle-formed region" becomes greater and becomes more likely to be below the meniscus holding pressure (−V), and the meniscus becomes more likely to be broken. Therefore, the pressure in the outlet DO2 of the outflow channel 35 cannot be kept constant at a very low pressure unless the inlet DI1 of the inflow channel 33 is pressurized.

However, according to the first modification, the negative pressure in the "nozzle-formed region" can be reduced by pressurizing the inlet DI1 of the inflow channel 33 to a positive pressure as in the graph yb of FIG. 9 even in the case where the pressure in the outlet DO2 of the outflow channel 35 is so low that the pressure of the "nozzle-formed region" is below the meniscus holding pressure (−V) when the pressure in the inlet DI1 of the inflow channel 33 is "0" or a negative pressure as in the graph yc of FIG. 9. Therefore, the flow amount of ink can be increased such that the pressure of the "nozzle-formed region" does not become below the meniscus holding pressure (−V).

As described above, according to the first modification, by increasing the pressure in the inlet DI1 of the inflow channel 33 (pressure on the upstream side of the valve element 72) in the case where the pressure in the outlet DO2 of the outflow channel 35 (pressure on the downstream side of the valve element 72) is lower, that is, the flow amount of ink is larger, the flow amount of ink can be increased while suppressing the breakage of the meniscus in the nozzles N even in the case where the pressure in the outlet DO2 of the outflow channel 35 is kept constant.

Figure 10:
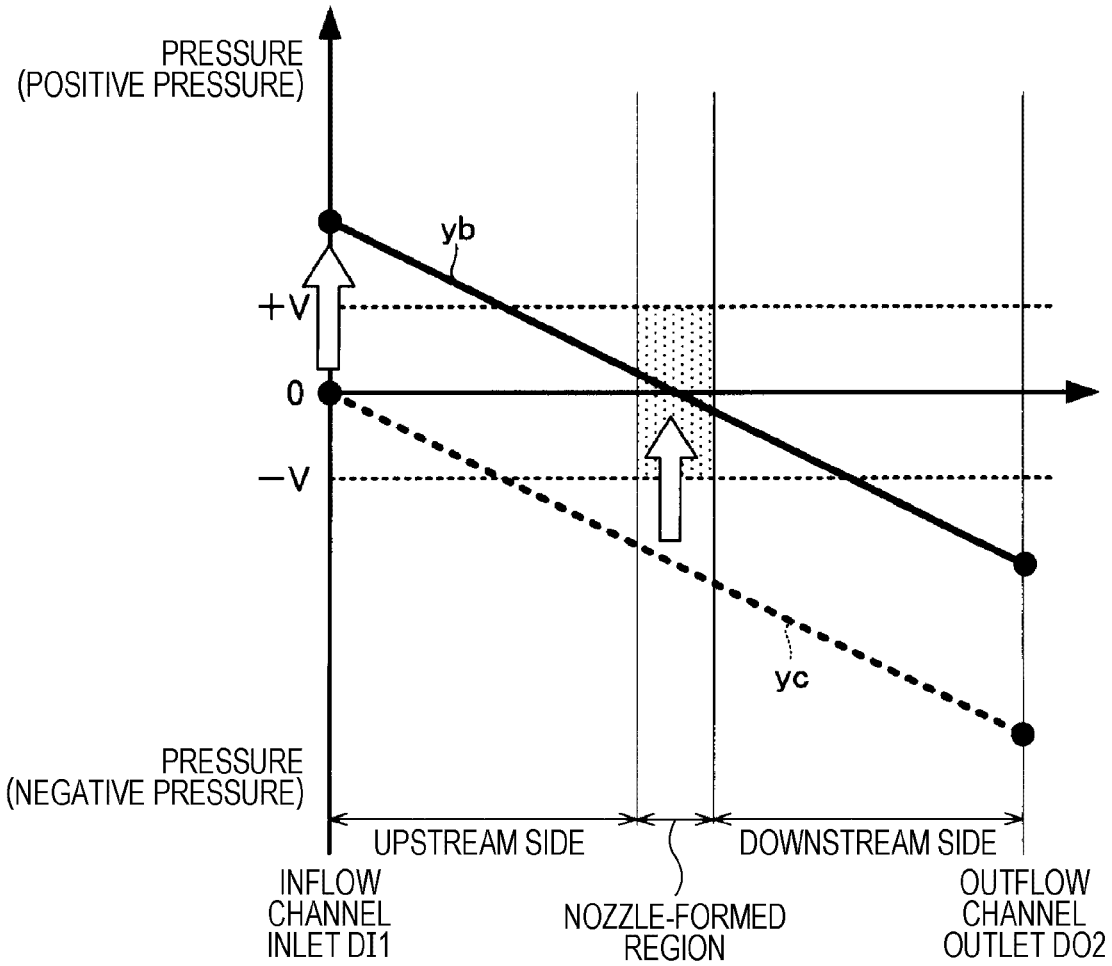
FIG. 10 is a graph illustrating pressure change in a second modification of the first embodiment.

In addition, although a case where the flow amount of the ink flow generated in the liquid ejecting head 20 is gradually increased has been described as an example in the first embodiment, the configuration is not limited. For example, the liquid transfer pump P may be constituted by a mechanical pump of a constant flow amount to keep the flow amount of ink constant as in a second modification of the first embodiment illustrated in FIG. 10. FIG. 10 is a graph illustrating change in pressure in the channel in which the ink flow is generated in the second modification of the first embodiment, and the pressure at each position in the channel in which the ink flow is generated is approximated by a straight line therein. In FIG. 10, a graph yb shows pressure change in the case where the pressure in the inlet DI1 of the inflow channel 33 is a positive pressure in the second modification, and a graph yc shows pressure change in the case where the pressure in the inlet DI1 of the inflow channel 33 is "0" in a comparative example. The flow amounts of ink (inclinations) of the graphs yb and yc are the same.

In the case of using the mechanical pump of the constant flow amount as the liquid transfer pump P, the flow amount of ink can be increased more when a mechanical pump of a larger flow amount is used. However, as in the graph yc of the comparative example of FIG. 10, in the case where a mechanical pump of a larger flow amount is used, the pressure in the outlet DO2 of the outflow channel 35 is decreased more, the negative pressure in the "nozzle-formed region" becomes greater and becomes more likely to be below the meniscus holding pressure (−V), and the meniscus becomes more likely to be broken. Therefore, the mechanical pump of a large flow amount cannot be used as the liquid transfer pump P unless the inlet DI1 of the inflow channel 33 is pressurized.

According to the second modification, the negative pressure in the "nozzle-formed region" can be reduced by pressurizing the inlet DI1 of the inflow channel 33 to a positive pressure as in the graph yb of FIG. 10 even in the case where a mechanical pump of such a large flow amount is used that the pressure in the outlet DO2 of the outflow channel 35 becomes so low as to make the pressure of the "nozzle-formed region" below the meniscus holding pressure (−V) when the pressure in the inlet DI1 of the inflow channel 33 is "0" or a negative pressure as in the graph yc of FIG. 10. Therefore, the flow amount of ink can be increased such that the pressure of the "nozzle-formed region" does not become below the meniscus holding pressure (−V).

As described above, according to the second modification, in the case of using a mechanical pump of a constant flow amount as the liquid transfer pump P, the breakage of the meniscus in the nozzles N can be suppressed even in the case of using a mechanical pump of a large flow amount by pressurizing the inflow channel 33 to a higher pressure when the flow amount of the mechanical pump is larger.

Second Embodiment

A second embodiment of the invention will be described. Same reference signs used in the description of the first embodiment will be used for elements in the embodiment described below having the same effects and functions as in the first embodiment, and detailed description thereof will be omitted as appropriate. In the channel configuration of the liquid ejecting head 20 according to the first embodiment, a case where the valve device 70 in which the valve element 72 is opened in accordance with the pressure on the downstream side of the valve element 72 is provided has been described as an example. In the channel configuration of the liquid ejecting head 20 according to the second embodiment, a case where the valve device 70 in which the valve element 72 can be also opened by an external force regardless of the pressure on the downstream side of the valve element 72 is provided will be described as an example.

Figure 11:
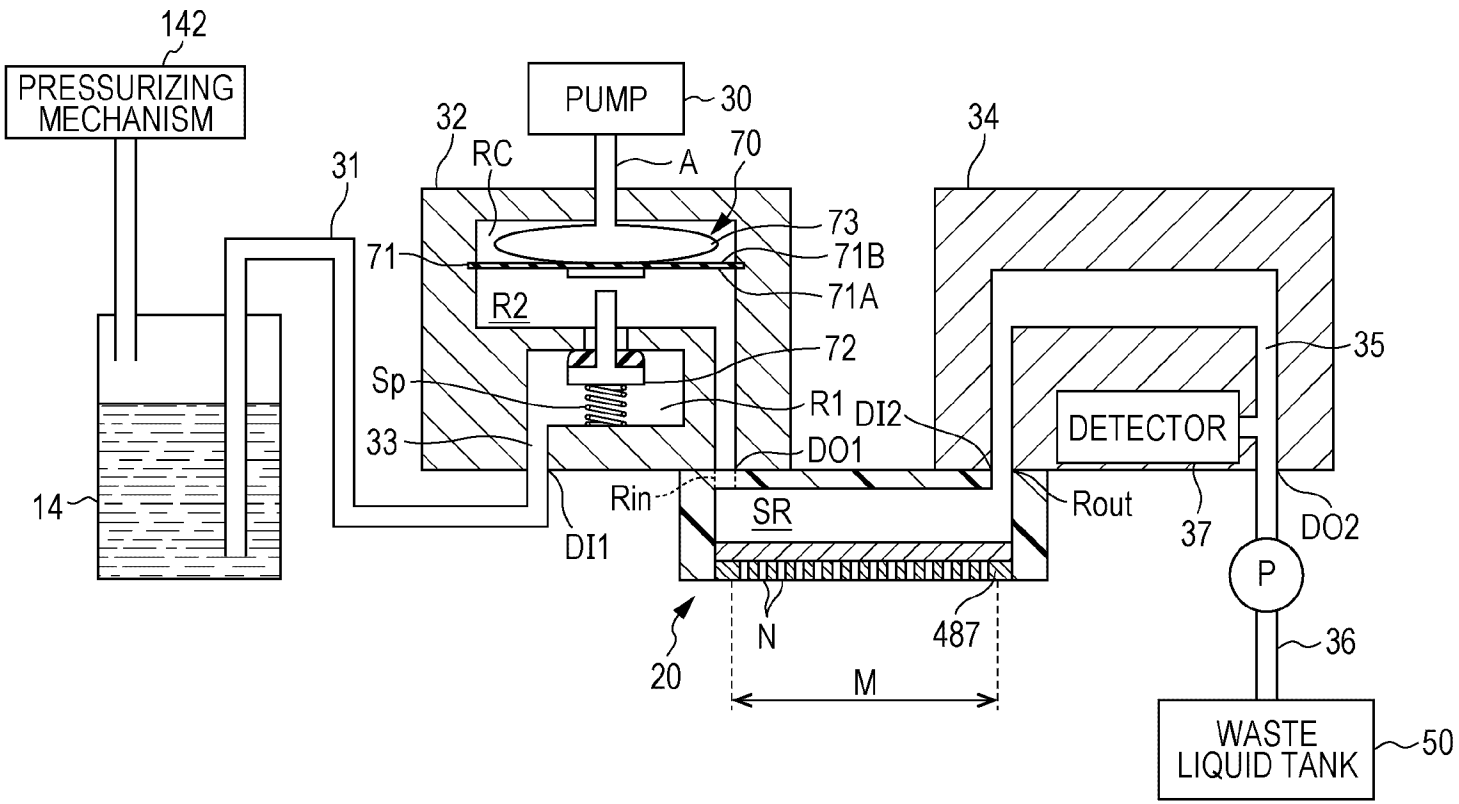
FIG. 11 is a diagram for describing a channel configuration of a liquid ejecting head according to a second embodiment.

FIG. 11 is a diagram for describing a channel configuration of a liquid ejecting head 20 according to the second embodiment, and corresponds to FIG. 4. The valve device 70 of FIG. 11 is opened by a pressure difference between the pressure on the downstream side and the atmospheric pressure, and can be also forcibly opened (forced opening operation) by an external force. A bag-shaped body 73 is disposed in the atmospheric pressure chamber RC. The bag-shaped body 73 is a bag-shaped member formed from an elastic material such as rubber. The bag-shaped body 73 is connected to a pump 30 via a gas channel A. The pump 30 of the present embodiment is a pump capable of pressurizing and depressurizing the gas channel A, and is typically constituted by an air pressure pump. The pump 30 may be constituted by a single pump that can be used for both of pressurization and depressurization, or may be constituted by two separate pumps respectively used for pressurization and depressurization. The pump 30 is driven in accordance with a sequence selected from a plurality of sequences in accordance with an instruction from the control apparatus 12. The plurality of sequences include a pressurizing sequence of supplying air to the gas channel A and a depressurizing sequence of sucking air from the gas channel A. The bag-shaped body 73 swells when the gas channel A is pressurized (by supplying air) in the pressurizing sequence, and the bag-shaped body 73 contracts when the gas channel A is depressurized (by sucking air) in the depressurizing sequence.

In the state in which the bag-shaped body 73 is contracted, in the case where the pressure in the downstream channel R2 is maintained in a predetermined range, the valve element 72 is urged by the spring Sp to be pressed upward (toward the −Z side), and thus the upstream channel R1 and the downstream channel R2 are blocked from each other. In contrast, in the case where the pressure in the downstream channel R2 is decreased to reach a predetermined negative pressure due to ejection and suction of ink by the liquid ejecting head 20, the valve element 72 is opened.

In addition, by causing the bag-shaped body 73 to swell by the pressurization by the pump 30, the flexible film 71 can be deformed by an external force from the bag-shaped body 73 regardless of the negative pressure (pressure difference) in the downstream channel R2 to forcibly open the valve element 72. That is, the opening operation of the valve element 72 by the external force described herein corresponds to opening the inflow channel 33 by forcibly opening the valve element 72 (forced opening operation) by the external force regardless of the negative pressure (pressure difference) in the downstream channel R2. To be noted, the valve element 72 may be forcibly opened by deforming the flexible film 71 by using a pressing force from a pressurizing rubber or a pressing force from a cam as an external force instead of the pressure from the pump 30.

According to such a channel configuration of the present embodiment, by driving the liquid transfer pump P, the downstream side of the valve element 72 is depressurized and the valve element 72 is opened to open the inflow channel 33, and thus an ink flow in which the ink in the liquid container 14 flows from the inflow channel 33 to the outflow channel 35 through the common liquid chamber SR can be generated. Specifically, similarly to the valve device 70 of FIG. 4, when the liquid transfer pump P is driven, the pressure in the outlet DO2 of the outflow channel 35 decreases to be a negative pressure, and thus the pressure in the downstream channel R2 communicating with the outflow channel 35 through the common liquid chamber SR also becomes a negative pressure. The flexible film 71 deforms due to the pressure difference between this negative pressure and the atmospheric pressure, and the valve element 72 opens when the pressure reaches the predetermined negative pressure. As a result of this, the valve element 72 opens to open the inflow channel 33, and the ink in the liquid container 14 flows from the inflow channel 33 to the outflow channel 35 through the common liquid chamber SR, and is discharged to the waste liquid tank 50 through the discharge channel 36.

In the case where just opening the valve element 72 on the basis of a negative pressure on the downstream side of the valve element 72 and the atmospheric pressure does not realize an enough flow amount of ink or enough pressure on the downstream side of the valve element 72 as in the present embodiment, there is a possibility that the opening operation of the valve element 72 becomes unstable because the valve element 72 becomes difficult to move. In the case where the opening operation of the valve element 72 becomes unstable, the ink flow generated in the liquid ejecting head 20 also becomes unstable, and the effect of suppressing precipitation of components of liquid is degraded.

Therefore, in the second embodiment, the valve element 72 to be opened in accordance with the negative pressure on the downstream side of the valve element 72 is forcibly opened by an external force to open the inflow channel 33, and thus an ink flow from the inflow channel 33 to the outflow channel 35 through the common liquid chamber RS is generated. According to this, an ink flow can be generated by forcibly opening the valve element 72 by forcibly deforming the flexible film 71 by the external force from the pump 30 in the case where the flow amount of ink is small and the opening operation of the valve element 72 becomes unstable. As a result of this, the opening operation of the valve element 72 can be assisted in accordance with the flow amount of ink. Therefore, the opening operation of the valve element 72 at the time of generating an ink flow in the liquid ejecting head 20 can be stabilized. In addition, by performing second control by driving the pump 30 in accordance with the flow amount of ink, the load on the pump 30 can be reduced as compared with a case where the flow is generated by always driving the pump 30.

Figure 12:
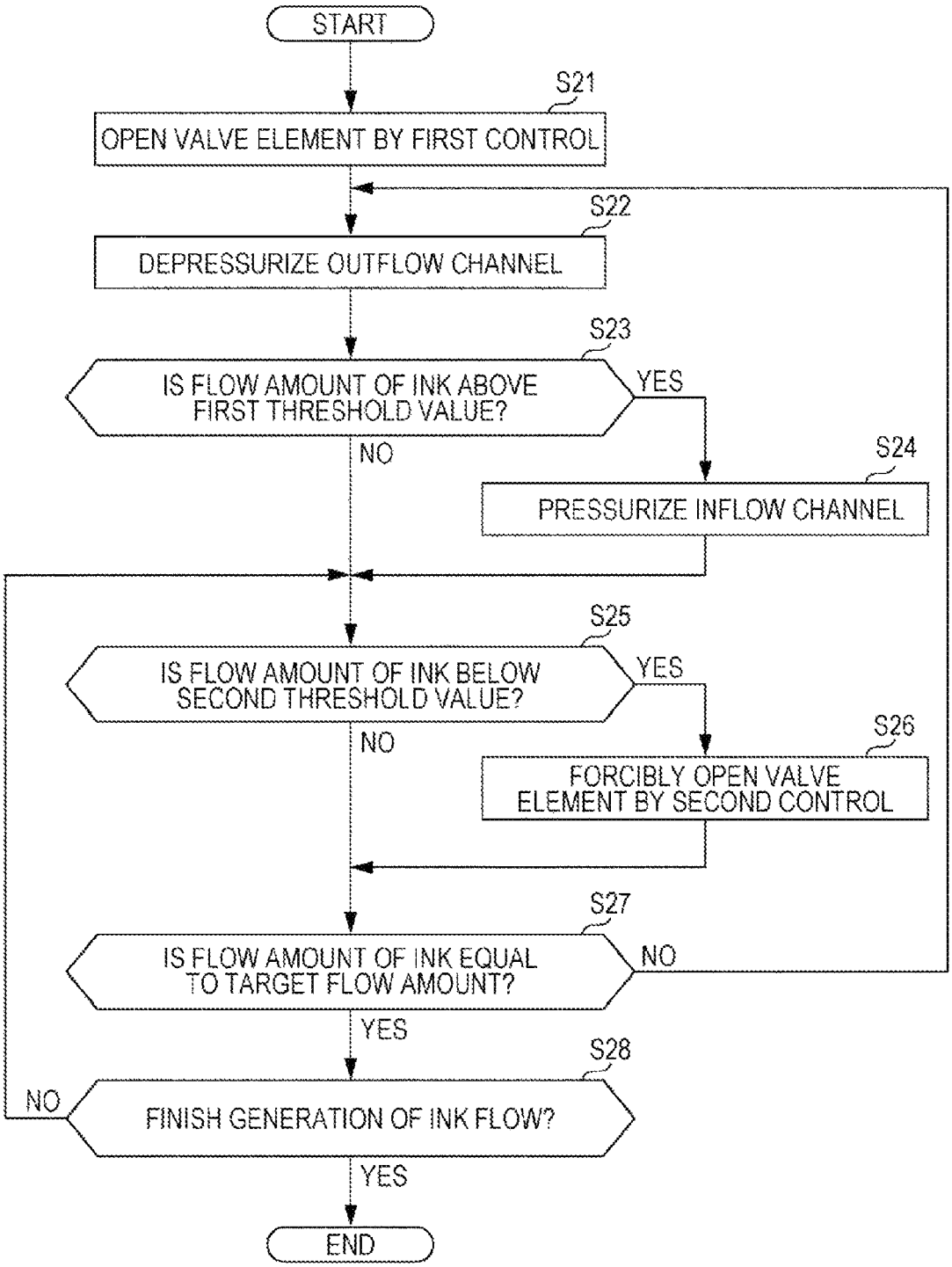
FIG. 12 is a flowchart illustrating a control method of the liquid ejecting apparatus according to the second embodiment.
Figure 13:
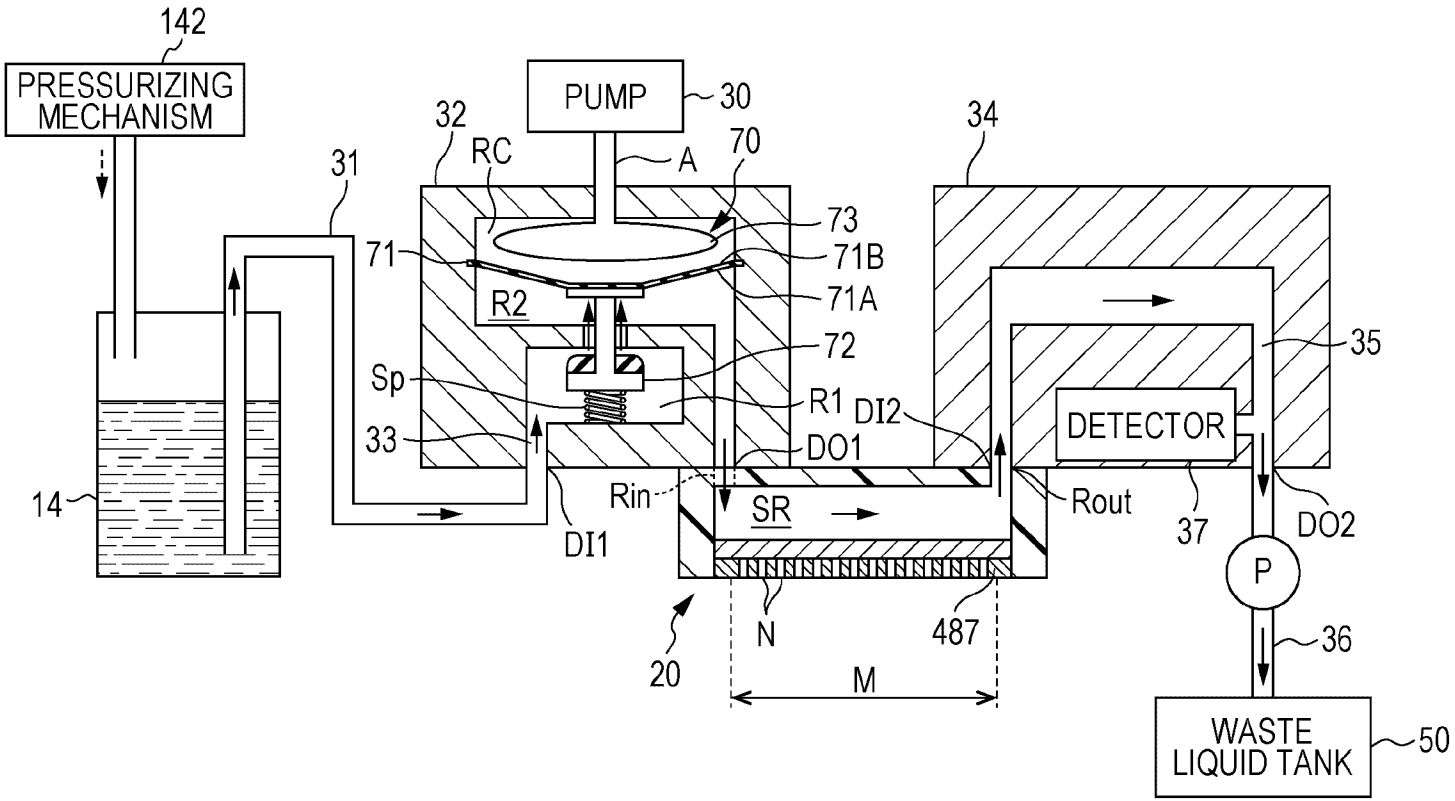
FIG. 13 is a diagram for describing an opening operation of a valve element in first control of the second embodiment.
Figure 14:
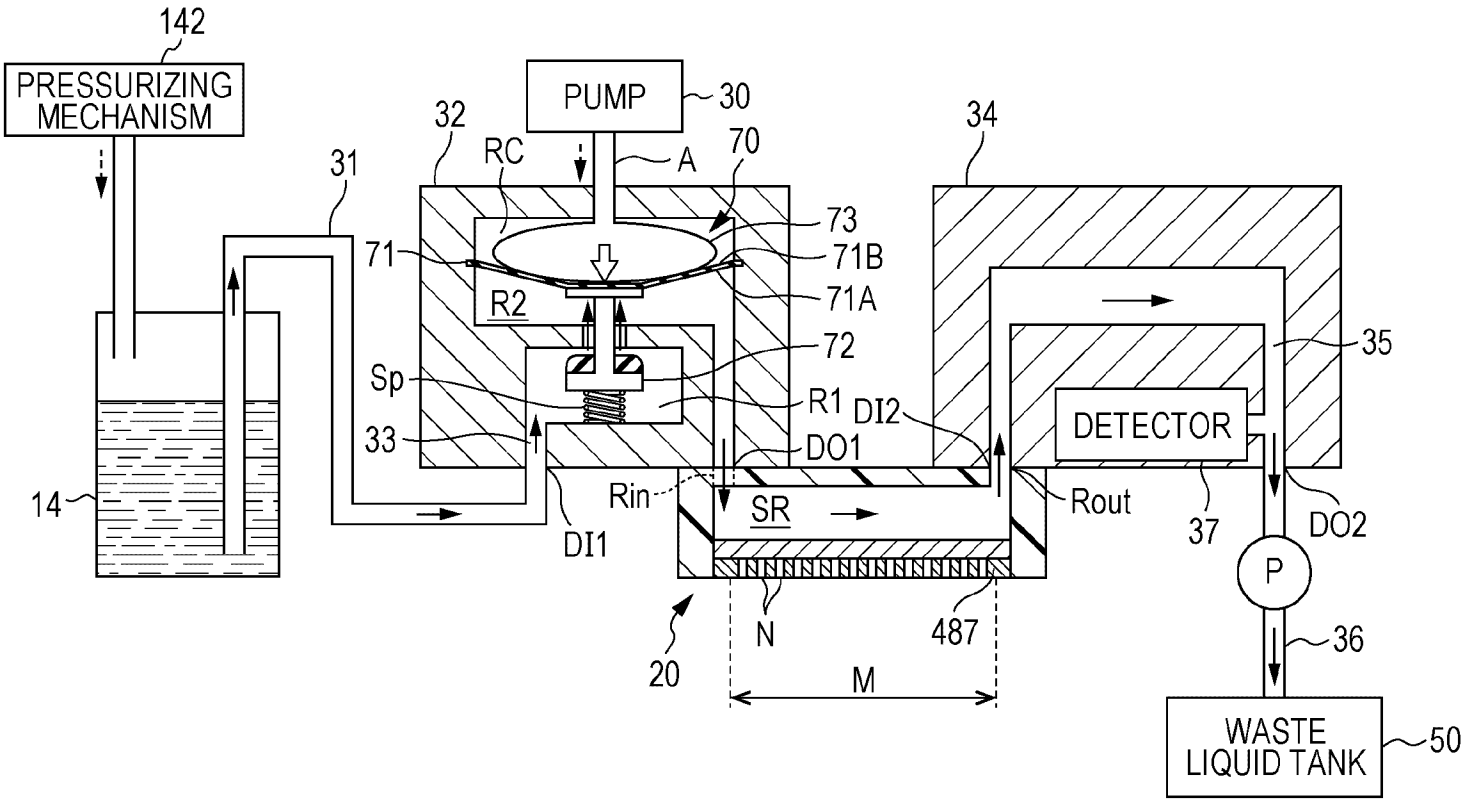
FIG. 14 is a diagram for describing a forced opening operation of the valve element in second control of the second embodiment.

Next a control method of the liquid ejecting apparatus 10 for generating such an ink flow will be described. FIG. 12 is a flowchart illustrating a control method of the liquid ejecting apparatus 10 for generating an ink flow in the second embodiment. In FIG. 12, control of generating an ink flow from the inflow channel 33 to the outflow channel 35 through the common liquid chamber SR by opening the inflow channel 33 by the opening operation of the valve element 72 in accordance with the negative pressure on the downstream side of the valve element 72 is referred to as first control. In addition, control of generating the ink flow from the inflow channel 33 to the outflow channel 35 through the common liquid chamber SR by opening the inflow channel 33 by a forced opening operation of the valve element 72 by an external force from the pump 30 is referred to as second control. FIG. 13 is a diagram for describing the opening operation of the valve element 72 in the first control, and FIG. 14 is a diagram for describing the forced opening operation of the valve element 72 in the second control. To be noted, steps S22, S23, S24, S27, and S28 of FIG. 12 are respectively similar to steps S11, S12, S13, S14, and S15 of FIG. 7, and therefore detailed descriptions thereof will be omitted.

As illustrated in FIG. 12, first, the control apparatus 12 opens the valve element 72 by first control in step S21, depressurizes the outflow channel 35 in step S22, and thus opens the valve element 72 to generate an ink flow in the common liquid chamber SR. Specifically, by making the pressure (pressure in the downstream channel R2) in the outlet DO2 of the outflow channel 35 a negative pressure by driving the liquid transfer pump P, the valve element 72 is opened to open the inflow channel 33 by deformation of the flexible film 71 due to the pressure difference between the negative pressure and the atmospheric pressure. As a result of this, the valve element 72 opens as illustrated in FIG. 13, and the ink flow from the inflow channel 33 to the outflow channel 35 through the common liquid chamber SR is generated. In addition, the flow amount of ink flow increases more in the case where the negative pressure in the outlet DO2 of the outflow channel 35 is greater.

Next, in step S23, the control apparatus 12 determines whether or not the flow amount of ink is above a predetermined first threshold value. Specifically, the control apparatus 12 determines whether or not the flow amount of ink in the outflow channel 35 detected by the detector 37 is above the first threshold value. In the case where the control apparatus 12 has determined that the flow amount of ink is above the first threshold value in step S23 (YES), the control apparatus 12 pressurizes the inflow channel 33 in step S24, and progresses to step S25. Specifically, the control apparatus 12 pressurizes the inflow channel 33 by the pressurizing mechanism 142 to increase the pressure in the inlet DI1 of the inflow channel 33. As a result of this, the flow amount can be increased, and the pressure of the "nozzle-formed region" can be prevented from becoming below the meniscus holding pressure (−V). Therefore, the breakage of the meniscus caused by the increase in the negative pressure in the nozzles N can be suppressed even in the case where the flow amount of the ink flow generated in the liquid ejecting head 20 is increased.

In the case where the control apparatus 12 has determined that the flow amount of ink is not above the first threshold value in step S23 (NO), the control apparatus 12 determines whether or not the flow amount of ink is below a second threshold value in step S25. Specifically, the control apparatus 12 determines whether or not the flow amount of ink in the outflow channel 35 detected by the detector 37 is below the second threshold value. The second threshold value is such a flow amount that the opening operation of the valve element 72 becomes unstable when the flow amount of ink becomes below the second threshold value. Specifically, for example, the predetermined threshold value is a flow amount equal to or smaller than approximately 30% to 50% of a flow amount of full ejection (ejection duty is 100%). Here, ejection duty is a ratio of amount of ink ejection with respect to the maximum possible amount of ink ejection per unit time. The flow amount below which the opening operation of the valve element 72 becomes unstable varies depending on the type and individual difference of the apparatus and the type of ink. Therefore, the flow amount below which the opening operation of the valve element 72 becomes unstable may be measured by generating the ink flow while changing the flow amount, and the threshold value may be determined on the basis of results of the measurement.

In the case where the control apparatus 12 has determined that the flow amount of ink is below the second threshold value in step S25 (YES), the control apparatus 12 forcibly opens the valve element 72 by the second control in step S26, and thus generates an ink flow in the common liquid chamber SR. Then, the control apparatus 12 determines whether or not the flow amount of ink has reached a target flow amount in step S27. Specifically, as illustrated in FIG. 14, the valve element 72 is forcibly opened to open the inflow channel 33 by driving the pump 30 to expand the bag-shaped body 73 to deform the flexible film 71. As described above, in the case where the flow amount of ink is below the predetermined threshold value, that is, where the opening operation of the valve element 72 becomes unstable under the first control, the inflow channel 33 is opened by forcibly opening the valve element 72 by the second control, and thus the opening operation of the valve element 72 by the first control can be assisted by the second control. Therefore, the opening operation of the valve element 72 at the time of generating an ink flow in the common liquid chamber SR can be stabilized. In the case where the control apparatus 12 has determined that the flow amount of ink has not reached the target flow amount in step S27 (NO), the process returns to step S21, and the outflow channel 35 is further depressurized to increase the flow amount of ink.

In addition, the control apparatus 12 also determines whether or not the flow amount of ink has reached the target flow amount in step S27 also in the case where the control apparatus 12 has determined that the flow amount of ink is not below the second threshold value in step S25 (NO). In this case, the control apparatus 12 determines whether or not the flow amount of ink has reached the target flow amount by opening the valve element 72 by the first control, and, in the case where the control apparatus 12 has determined that the flow amount of ink has not reached the target flow amount in step S27 (NO), the process returns to step S21, and the outflow channel 35 is further depressurized to increase the flow amount of ink.

In the case where the control apparatus 12 has determined that the flow amount of ink has reached the target flow amount in step S27 (YES), the control apparatus 12 determines whether or not to finish generation of the ink flow in step S28. In the case where the control apparatus 12 has determined not to finish the generation of ink flow in step S28 (NO), the process returns to step S25. By returning to step S25, the control apparatus 12 monitors the flow amount of ink until the generation of ink flow is finished. In the case where the control apparatus 12 has determined to finish the generation of ink flow in step S28 (YES), the control apparatus 12 stops the liquid transfer pump P and finishes the control of generating an ink flow.

As described above, according to the control of the second embodiment, the flow amount of ink can be directly detected by detecting the flow amount of ink in the outflow channel 35 by the detector 37. Therefore, by performing the second control on the basis of the flow amount detected by the detector 37, the forced opening operation of the valve element 72 by the second control can be performed appropriately. To be noted, the detector 37 may be provided in the inflow channel 33 and the forced opening operation of the valve element 72 by the second control may be performed in accordance with the detected flow amount of ink. In addition, in the case of detecting the pressure of ink by the detector 37, the forced opening operation of the valve element 72 by the second control may be performed in accordance with the detected pressure of ink. By detecting the pressure in the outflow channel 35, the flow amount of ink can be indirectly detected. Therefore, by performing the second control on the basis of the detected pressure, the forced opening operation of the valve element 72 by the second control can be performed appropriately.

In addition, according to the control of the second embodiment, in the case where the flow amount of ink is small and the valve element 72 is likely to be unstable with the opening operation of the valve element 72 according to the negative pressure on the downstream side performed by the first control, an ink flow is generated by opening the inflow channel 33 by forcibly opening the valve element 72 by an external force by the second control. As a result of this, the opening operation of the valve element 72 can be stabilized. In addition, the valve element 72 does not have to be opened by increasing the flow amount in the case where the flow amount of ink is small. Therefore, also in the case where the ink that has generated the ink flow is discarded to the waste liquid tank 50 as in the channel configuration of FIG. 4, the amount of ink to be discarded can be greatly reduced as compared with the case where the valve element 72 is opened by increasing the flow amount of ink.

To be noted, at the time of maintenance of the liquid ejecting head 20, the ink flow is generated by the first control and the second control before the liquid ejecting head 20 is sealed by the cap 242, that is, in a state in which the liquid ejecting head 20 and the cap 242 are separated from each other. According to this, the meniscus of the nozzles N is less likely to be broken by a droplet or the like that attaches to the cap 242 at the time of generating an ink flow as compared with the case where the ink flow is generated in a state in which the liquid ejecting head 20 and the cap 242 are in contact with each other. Therefore, an operation of restoring the meniscus of the nozzles N does not have to be performed after sealing the liquid ejecting head 20 with the cap 242.

A case where the pressure in the outflow channel 35 is set to a negative pressure and the pressure in the inflow channel 33 (pressure on the upstream side of the valve element 72) is set to a positive pressure has been described as an example in the embodiments described above. However, the configuration is not limited to this, and both of the pressure in the outflow channel 35 and the pressure in the inflow channel 33

(pressure on the upstream side of the valve element 72) may be negative pressures or positive pressures.

Third Embodiment

A third embodiment of the invention will be described. A case where the ink that generates a flow in the liquid ejecting head 20 is discharged to the waste liquid tank 50 has been described as an example in the second embodiment. In the third embodiment, a case where the ink that generates a flow in the liquid ejecting head 20 is returned to the liquid container 14 to circulate will be described as an example.

Figure 15:
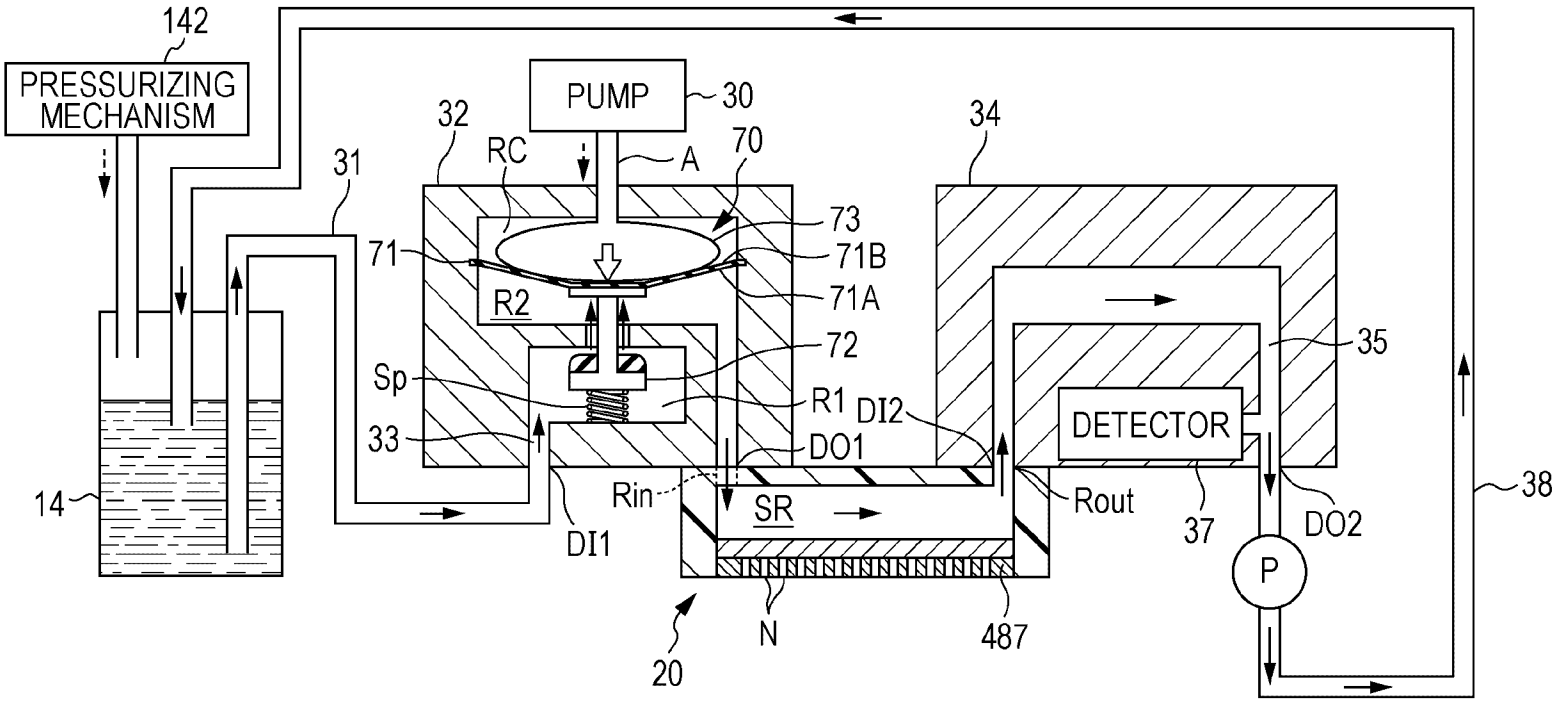
FIG. 15 is a diagram for describing a channel configuration of a liquid ejecting head according to a third embodiment.

FIG. 15 is a diagram for describing a channel configuration of a liquid ejecting head 20 according to the third embodiment. In the channel configuration of FIG. 15, a circulation channel 38 is connected to the outlet DO2 of the outflow channel 35. The circulation channel 38 is a flow channel for returning the ink discharged from the outlet DO2 of the outflow channel 35 to the liquid container 14. The liquid transfer pump P of FIG. 15 is provided in the circulation channel 38. To be noted, the liquid transfer pump P of the present embodiment is a mechanical pump of a constant flow amount such as a tube pump or a gear pump, and has a pressure resistance high enough to avoid flowing back of the ink caused by the pressure (air pressure) of the pressurizing mechanism 142.

According to the channel configuration of FIG. 15, the valve element 72 can be opened to open the inflow channel 33 by driving the liquid transfer pump P by the first control similarly to the channel configuration of FIG. 11. In addition, the valve element 72 can be forcibly opened to open the inflow channel 33 by driving the pump 30 by the second control. In the configuration of FIG. 15, when the inflow channel 33 is opened, the ink in the liquid container 14 flows from the inflow channel 33 to the outflow channel 35 through the common liquid chamber SR, and returns to the liquid container 14 through the circulation channel 38.

The control of FIG. 12 can be also performed in the channel configuration of FIG. 15. In addition, according to the channel configuration of FIG. 15, the valve element 72 to be opened in accordance with the negative pressure on the downstream side of the valve element 72 can be forcibly opened by an external force to open the inflow channel 33, and thus an ink flow from the inflow channel 33 to the outflow channel 35 through the common liquid chamber RS can be generated. According to this, the valve element 72 opened by the first control can be forcibly opened by the second control in the case where the operation of the valve element 72 is unstable due to, for example, insufficient flow amount of ink. Therefore, the operation of the valve element 72 at the time of generating an ink flow in the liquid ejecting head 20 can be also stabilized according to the channel configuration of FIG. 15. In addition, according to the channel configuration of FIG. 15, since the ink that generates a flow in the liquid ejecting head 20 is returned to the liquid container 14 to circulate, the ink that generates a flow does not have to be discarded, and thus wasteful consumption of ink can be reduced.

A case where the pressure in the outflow channel 35 is set to a negative pressure and the pressure in the inflow channel 33 (pressure on the upstream side of the valve element 72) is set to a positive pressure has been described as an example in the embodiments described above. However, the configuration is not limited to this, and both of the pressure in the outflow channel 35 and the pressure in the inflow channel 33 (pressure on the upstream side of the valve element 72) may be negative pressures or positive pressures.

Modification

The embodiments described above can be modified in various ways. Specific modifications will be described below as examples. Two or more embodiments arbitrarily selected from the examples below and the embodiments above can be appropriately combined as long as the combination is not contradictory.

(1) Although a serial head in which the carriage 18 mounting the liquid ejecting head 20 is reciprocated in the X direction has been described as an example in the embodiments described above, the invention can be also applied to a line head in which the liquid ejecting head 20 is disposed over the whole width of the medium 11.

(2) Although the liquid ejecting head 20 of a piezoelectric system using a piezoelectric element that imparts mechanical vibration to a pressure chamber has been described as an example in the embodiments described above, a liquid ejecting head of a thermal system using a heat generating element that generates bubbles in the pressure chamber by heat can be also employed.

(3) The liquid ejecting apparatus 10 described as an example in the embodiments described above can be employed for various devices such as a facsimile machine and a copier in addition to a device exclusively used for printing. Of course, the use of the liquid ejecting apparatus 10 of the invention is not limited to printing. For example, a liquid ejecting apparatus that ejects a liquid of a color material can be used as a production apparatus that produces a color filter for a liquid crystal display apparatus, an organic electroluminescence (EL) display, a field emission display (FED), or the like. In addition, a liquid ejecting apparatus that ejects a solution of a conductive material can be used as a production apparatus that forms wiring and electrodes in a wired board. In addition, the liquid ejecting apparatus can be also used as a chip production apparatus that ejects a solution of bio-organic substance as a kind of liquid.

The entire disclosure of Japanese Patent Application No. 2017-175721, filed Sep. 13, 2017 is expressly incorporated by reference herein.

What is claimed is:

1. A control method of a liquid ejecting apparatus,
the liquid ejecting apparatus including
a liquid ejecting head that has an inner space in which a liquid flows and that ejects the liquid in the inner space through a nozzle,
an inflow channel through which the liquid flows into the inner space,
an outflow channel through which the liquid in the inner space flows out, and
a valve element that opens and closes the inflow channel,
the control method comprising:
reducing a pressure in the outflow channel to open the valve element, such that a flow amount of liquid is caused to flow into the liquid ejecting head via the inflow channel, and
when the flow amount is greater than a predetermined threshold due to the reduction of the pressure in the outflow channel, increasing a pressure in the inflow channel to increase a pressure difference between the pressure in the inflow channel and the pressure in the outflow channel.

2. The control method of a liquid ejecting apparatus according to claim 1, wherein the valve element is opened by depressurizing the outflow channel.

3. The control method of a liquid ejecting apparatus according to claim 1, wherein the liquid ejecting apparatus includes a flexible film for moving the valve element, wherein the flexible film has a first surface that constitutes part of the inflow channel downstream of the valve element and a second surface opposite to the first surface, and wherein the valve element is opened by deformation of the flexible film according to pressure difference between a pressure on the first surface and a pressure on the second surface.

4. The control method of a liquid ejecting apparatus according to claim 3, wherein the valve element is opened regardless of the pressure difference by deforming the flexible film by applying an external force to the second surface of the flexible film.

5. The control method of a liquid ejecting apparatus according to claim 3, wherein when the flow amount is less than a second predetermined threshold, the valve element is opened regardless of the pressure difference by deforming the flexible film by applying an external force to the second surface of the flexible film.

6. The control method of a liquid ejecting apparatus according to claim 1, wherein the liquid ejecting apparatus includes a cap that comes into contact with the liquid ejecting head to seal the nozzle, and the liquid flow from the inflow channel to the outflow channel through the inner space is generated by opening the inflow channel by opening the valve element in accordance with a negative pressure on a downstream side of the valve element in a state in which the liquid ejecting head and the cap are separated from each other.

7. The control method of a liquid ejecting apparatus according to claim 1, wherein at least one of a pressure in the inflow channel and a pressure in the outflow channel is changed stepwise.

8. The control method of a liquid ejecting apparatus according to claim 1, the liquid ejecting apparatus further including a detector disposed in the outflow channel configured to detect a flow amount in the outflow channel, the control method further comprising:

increasing a pressure in the inflow channel to increase the flow amount of liquid flown into the liquid ejecting head, causing the detector to detect a flow amount in the outflow channel, and when the detected flow amount is greater than a predetermined threshold, reducing the pressure in the outflow channel, and increasing a pressure in the inflow channel to increase a pressure difference between the pressure in the inflow channel and the pressure in the outflow channel.

9. The control method of a liquid ejecting apparatus according to claim 1, wherein the liquid ejecting apparatus includes a waste liquid tank for discharging the liquid from the inner space, the waste liquid tank being communicated with the inner space via the outflow channel.

10. The control method of a liquid ejecting apparatus according to claim 1, wherein when the flow amount is greater than the predetermined threshold due to the reduction of the pressure, the control method increases the pressure in the inflow channel so as to be a positive pressure.

11. A liquid ejecting apparatus comprising:

a liquid ejecting head that has an inner space in which a liquid flows and that ejects the liquid in the inner space through a nozzle;

an inflow channel through which the liquid flows into the inner space;

an outflow channel through which the liquid in the inner space flows out; and a valve element that opens and closes the inflow channel, wherein the liquid ejecting apparatus is configured to:

reduce a pressure in the outflow channel to open the valve element in accordance with a negative pressure on a downstream side of the valve element, such that a flow amount of liquid is caused to flow into the liquid ejecting head via the inflow channel, and when the flow amount is greater than a predetermined threshold due to the reduction of the pressure in the outflow channel, increasing a pressure in the inflow channel to increase a pressure difference between the pressure in the inflow channel and the pressure in the outflow channel.

12. The liquid ejecting apparatus according to claim 11, wherein the valve element is opened by depressurizing the outflow channel.

13. The liquid ejecting apparatus according to claim 11, wherein the liquid ejecting apparatus includes a flexible film for moving the valve element, wherein the flexible film has a first surface that constitutes part of the inflow channel downstream of the valve element and a second surface opposite to the first surface, and wherein the valve element is opened by deformation of the flexible film according to pressure difference between a pressure on the first surface and a pressure on the second surface.

14. The liquid ejecting apparatus according to claim 13, wherein the valve element is opened regardless of the pressure difference by deforming the flexible film by applying an external force to the second surface of the flexible film.

15. The liquid ejecting apparatus according to claim 14, wherein when the flow amount is less than a second predetermined threshold, the valve element is opened regardless of the pressure difference by deforming the flexible film by applying an external force to the second surface of the flexible film.

16. The liquid ejecting apparatus according to claim 11, wherein the liquid ejecting apparatus includes a cap that comes into contact with the liquid ejecting head to seal the nozzle, and the liquid flow from the inflow channel to the outflow channel through the inner space is generated by opening the inflow channel by opening the valve element in accordance with a negative pressure on a downstream side of the valve element in a state in which the liquid ejecting head and the cap are separated from each other.

17. The liquid ejecting apparatus according to claim 11, wherein a flow amount of the liquid flow is changed by changing at least one of a pressure in the inflow channel and a pressure in the outflow channel.

18. The liquid ejecting apparatus according to claim 11, further comprising a detector disposed in the outflow channel configured to detect a flow amount in the outflow channel, the liquid ejecting apparatus further configured to:

increase a pressure in the inflow channel to increase the flow amount of liquid flown into the liquid ejecting head, cause the detector to detect a flow amount in the outflow channel, and when the detected flow amount is greater than a predetermined threshold due to the reduction of the pressure in the outflow channel, increase a pressure in the inflow channel to increase a pressure difference between the pressure in the inflow channel and the pressure in the outflow channel.

19. The liquid ejecting apparatus according to claim 11, further comprising a waste liquid tank for discharging the liquid from the inner space, the waste liquid tank being communicated with the inner space via the outflow channel.

20. The liquid ejecting apparatus according to claim 11, wherein when the flow amount is greater than the predetermined threshold due to the reduction of the pressure in the outflow channel, the liquid ejecting apparatus is configured to increase the pressure in the inflow channel so as to be a positive pressure.

* * * * *